US009363595B2

(12) United States Patent
Horibe et al.

(10) Patent No.: US 9,363,595 B2
(45) Date of Patent: Jun. 7, 2016

(54) MICROPHONE UNIT, AND SOUND INPUT DEVICE PROVIDED WITH SAME

(75) Inventors: Ryusuke Horibe, Osaka (JP); Tomohiro Taniguchi, Osaka (JP); Fuminori Tanaka, Osaka (JP); Takeshi Inoda, Osaka (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 509 days.

(21) Appl. No.: 13/530,824

(22) Filed: Jun. 22, 2012

(65) Prior Publication Data

US 2012/0328142 A1 Dec. 27, 2012

(30) Foreign Application Priority Data

Jun. 24, 2011 (JP) ..... 2011-141073
Jul. 8, 2011 (JP) ..... 2011-152212

(51) Int. Cl.

| | |
|---|---|
| ***H04R 11/04*** | (2006.01) |
| ***H04R 1/40*** | (2006.01) |
| ***H04R 3/00*** | (2006.01) |
| *H04R 1/08* | (2006.01) |

(52) U.S. Cl.

CPC ..... *H04R 1/406* (2013.01); *H04R 3/005* (2013.01); *H04R 1/086* (2013.01); *H04R 2499/11* (2013.01)

(58) Field of Classification Search

USPC ..... 381/355, 369
See application file for complete search history.

(56) References Cited

U.S. PATENT DOCUMENTS

| | | | | |
|---|---|---|---|---|
| 2005/0207605 | A1* | 9/2005 | Dehe et al. | 381/369 |
| 2008/0037768 | A1* | 2/2008 | Hsu et al. | 379/429 |
| 2008/0192963 | A1* | 8/2008 | Sato | H04R 19/005 381/174 |
| 2008/0318640 | A1* | 12/2008 | Takano et al. | 455/569.1 |

FOREIGN PATENT DOCUMENTS

| | | | |
|---|---|---|---|
| JP | 2003-508998 | A | 3/2003 |
| JP | 2008-092183 | A | 4/2008 |
| JP | 2008-510427 | A | 4/2008 |
| WO | 01/19134 | A2 | 3/2001 |
| WO | 2006-023016 | A1 | 3/2006 |

* cited by examiner

*Primary Examiner* — Duc Nguyen
*Assistant Examiner* — Phan Le
(74) *Attorney, Agent, or Firm* — Amster, Rothstein & Ebenstein, LLP

(57) ABSTRACT

A microphone unit includes first and second diaphragms; a substrate on a top surface of which are installed the first and second diaphragms; and a cover disposed covering the first and second diaphragms, the cover joined to an outside edge of the substrate and forming an internal space. There are formed in the substrate first and second openings that are formed respectively in the top and bottom surfaces of the substrate, and an internal sound path communicating from the first opening to the second opening. The first diaphragm is disposed on the substrate so as to cover and hide the first opening. The second diaphragm is disposed so as to seal off a partial region away from the first opening of the top surface of the substrate. A third opening is formed in the cover, and the internal space communicates to an outside space via the third opening.

17 Claims, 38 Drawing Sheets

MICROPHONE UNIT, AND SOUND INPUT DEVICE PROVIDED WITH SAME

CROSS-REFERENCE TO RELATED APPLICATIONS

This nonprovisional application claims priority under 35 U.S.C. §119(a) to Patent Application No. 2011-141073 filed in Japan on Jun. 24, 2011 and Patent Application No. 2011-152212 filed in Japan on Jul. 8, 2011, the contents of which are incorporated herein by reference in their entirety.

BACKGROUND OF THE INVENTION

1. Field of the Invention

The present invention relates to a microphone unit provided with a function of converting input sound to an electrical signal for output. The present invention also relates to a speech input device provided with such a microphone unit.

2. Description of Related Art

During a telephone conversation, or during speech recognition, speech recording, or the like, it is preferable to pick up only intended speech (the voice of a speaker). However, in environments in which speech input devices are used, sounds other than intended speech, such as background noise, may be present as well. For this reason, speech input devices that have a function of eliminating noise have been developed, making it possible to properly extract intended speech, even in cases of use in environments in which noise is present.

In recent years, there have been dramatic enhancements in the functionality of mobile devices such as mobile terminals, smartphones, and the like, in which there have aggressively started to be installed not only normal speech conversation, but also functions such as hands-free conversation, videophone functionality, speech recognition, and the like. Techniques by which devices having such functions may be made smaller and thinner have assumed increasing importance.

Omnidirectional microphones, which have a circular directionality pattern, are known as microphones that are adapted to pick up sound uniformly from all directions. Additionally, unidirectional microphones, which have a directionality pattern of a cardioid type, are known as microphones that are adapted to pick up sound from a particular direction. Moreover, bidirectional microphones, which have a figure "8" directionality pattern, are known as microphones that are adapted to minimize distant sounds, and to pick up nearby sounds only. These microphones are used selectively according to particular applications and purposes for use.

An omnidirectional microphone has a single sound hole, and is designed so that sound pressure inputted through the sound hole is transmitted to the front surface of a diaphragm of the microphone and the back surface of the diaphragm faces an enclosed region imparted with a baseline pressure.

A bidirectional microphone has two sound holes, and is designed so that sound pressure inputted through one of the sound holes is transmitted to the front surface of the diaphragm of the microphone, while sound pressure inputted through the other sound hole is transmitted to the back surface of the diaphragm, to thereby detect a pressure differential between the sound pressure inputted through the two sound holes (see, for example, Japanese Laid-open Patent Application No. 2003-508998).

A unidirectional microphone has two sound holes, and is designed so that sound pressure inputted through one of the sound holes is transmitted to the front surface of the diaphragm of the microphone, while sound pressure inputted through the other sound hole is transmitted to the back surface of the diaphragm through a delay member that imparts an acoustic delay, to detect a pressure differential between the sound pressure inputted through the two sound holes (see, for example, Japanese Laid-open Patent Application No. 2008-92183).

An example of a unidirectional microphone unit 101 is shown in FIG. 33. A substrate opening 106 that passes from the front surface to the back surface of a substrate is formed in a substrate part 102, and a diaphragm 103 is installed thereon in such a way as to block the substrate opening 106.

A cover 104 is installed over the substrate part 102, so as to cover the diaphragm 103, and the outer edge of the cover 104 is hermetically joined to the outer edge of the substrate part 102, forming an internal space that includes the diaphragm 103. The cover 104 is furnished with a sound hole 107, and sound pressure inputted from the outside is transmitted from the sound hole 107 to the front surface of the diaphragm 103, via the internal space.

An acoustic delay member 105 is disposed in such a way as to block the substrate opening 106 from the back side, and the unidirectional microphone is configured in such a way that sound pressure inputted from the outside passes through the acoustic delay member 105, and is transmitted to the back surface of the diaphragm 103 via the substrate opening 106. Felt material or the like is widely used as the acoustic delay member 105. Instead of being disposed to the back side of the substrate opening 106, the acoustic delay member 105 can be disposed in such a way as to block the sound hole 107 of the cover 104, as shown in FIG. 34.

Another method for configuring a unidirectional microphone is a configuration as shown in FIG. 35, in which two omnidirectional microphones are respectively mounted on the upper surface and the lower surface of a substrate part 102, the sound holes of the two microphones (a first sound hole 113 and a second sound hole 114) are disposed in such a way as to face up and down in opposite directions, and arithmetic operations are performed on the output signals of the respective microphones (see, for example, Japanese Laid-open Patent Application No. 2008-92183).

In recent years, the need to make mobile terminals and other such mobile devices even thinner has become increasingly intense. To meet this need, thinner omnidirectional microphones employing microelectromechanical systems (MEMS) have been developed, and microphones 1 mm or less in thickness have become commercially viable.

Meanwhile, in the case of unidirectional microphones such as shown in FIG. 33 and FIG. 34, it is necessary for the thickness of the unidirectional microphone to be equal to the thickness of the substrate part 102 and the cover part 104, plus the thickness of the acoustic delay member. A resultant problem is that, due to the additional thickness, reducing thickness becomes difficult.

According to another method, a unidirectional microphone is configured, as shown in FIG. 35, by respectively mounting two omnidirectional microphones on the top and bottom surfaces of a mounting substrate, and performing arithmetic operations on the output signals of the respective microphones. However, problems are presented in that, because the thickness of the resulting microphone is approximately doubled, reducing thickness becomes difficult.

SUMMARY OF THE INVENTION

It is an object of the present invention to afford a thin, unidirectional (inclusive of directionality approximating unidirectionality) microphone unit; and a speech input device provided therewith.

(1) The microphone unit according to the present invention comprises:

a first diaphragm and a second diaphragm for converting input sound pressure to an electrical signal;

a substrate on a top surface of which are installed the first diaphragm and the second diaphragm; and a cover for covering the first diaphragm and the second diaphragm, the cover joined to an outside edge of the substrate, and forming an internal space;

wherein there are formed in the substrate a first opening formed in the top surface of the substrate, a second opening formed in a bottom surface of the substrate, and an internal sound path communicating from the first opening to the second opening;

wherein the first diaphragm is disposed on the substrate so as to obscure the first opening;

wherein the second diaphragm is disposed so as to seal off a partial region away from the first opening in the top surface of the substrate; and wherein a third opening is formed in the cover, and the internal space communicates with an outside space via the third opening.

The diaphragm unit may be constituted as a microelectromechanical system (MEMS). As the diaphragms, inorganic piezoelectric thin films or organic piezoelectric thin films may be used; those effecting acoustic-electric conversion through the piezoelectric effect are acceptable, as is the use of an electret film. The substrate may be constituted by an insulating molded base material, fired ceramics, glass epoxy, plastic, or other such materials.

According to the present invention, sound that is inputted to the first diaphragm and the second diaphragm from a third opening, which serves as a common sound hole, is transmitted at identical pressure to both of the diaphragms, and therefore, by performing an arithmetic operation on the electrical signal outputted from the first diaphragm and the electrical signal outputted from the second diaphragm, the signal transmitted to the top surface of the first diaphragm can be completely canceled out, and the signal transmitted to the bottom surface of the first diaphragm can be isolated and extracted.

Herein, it is very important for the input sound hole to be common to the first diaphragm and the second diaphragm; and because errors due to spatial displacement do not occur, the signal transmitted to the top surface of the first diaphragm can be completely canceled out.

On the other hand, in a case in which the first diaphragm and the second diaphragm are individually furnished with input sound holes, despite being adjacently disposed, signal errors occur due to spatial displacement of position, and therefore the signal transmitted to the top surface of the first diaphragm cannot be completely canceled out.

In so doing, a process equivalent to a microphone unit in which two microphones are disposed on the top surface and the bottom surface of a substrate can be realized. Additionally, because it is unnecessary to dispose an acoustic delay member, it is possible to realize the characteristics of a unidirectional microphone, with thickness equal to that of an omnidirectional microphone. Consequently, installation in a thin-profile portable device is possible without increasing the thickness of the microphone. Furthermore, the directionality pattern of a unidirectional microphone can be realized.

According to the present invention, because the orientation (beam orientation) at which unidirectional sensitivity is highest faces in a direction perpendicular to a substrate surface of the substrate of the microphone unit, a resultant advantage is that, when the microphone is installed in a mobile device, the beam orientation is easily made to face in the direction of the speaker.

(2) In the microphone unit described in aspect (1), the internal sound path may include a space extending in a direction parallel to the upper surface of the substrate, within an interior layer of the substrate.

According to the aspect described in (2), in cases in which limitations of sound hole placement or spatial limitations during mounting of components make it difficult to achieve equality of the propagation distance d1 from the third opening to the first diaphragm and the propagation distance d2 from the second opening to the first diaphragm, the propagation distance d2 can be adjusted through formation of the aforedescribed internal sound path, so that the propagation distance d1 and the propagation distance d2 can be of the same length, and the symmetry of the bidirectional figure "8" shape can be improved, making it possible to maximize the effect of minimizing distant noise.

(3) The aforedescribed microphone unit of (1) or (2) may have a first adder for outputting a difference signal of a first electrical signal outputted by the first diaphragm and a second electrical signal outputted by the second diaphragm.

According to aspect (3), sound that is inputted to the first diaphragm and the second diaphragm from the third opening, which serves as a common sound hole, is transmitted at identical pressure to both of the diaphragms; therefore, by performing an arithmetic operation on the electrical signal outputted from the first diaphragm and the electrical signal outputted from the second diaphragm, the signal transmitted to the top surface of the first diaphragm can be completely canceled out, and the signal transmitted to the bottom surface of the first diaphragm can be isolated and extracted.

The first electrical signal outputted by the first diaphragm may be the unmodified signal outputted by the first diaphragm, or a signal obtained by amplification of the signal outputted by the first diaphragm. Likewise, the second electrical signal outputted by the second diaphragm may be the unmodified signal outputted by the second diaphragm, or a signal obtained by amplification of the signal outputted by the second diaphragm.

(4) The microphone unit described in aspect (3) may have a delay part for outputting a delay signal in which a predetermined delay is imparted to the difference signal; and a second adder for outputting an addition signal that adds the second electrical signal and the delay signal.

(5) The microphone unit described in aspect (3) may have a delay part for outputting a delay signal in which a predetermined delay is imparted to the second electrical signal; and a second adder for outputting an addition signal that adds the difference signal and the delay signal.

According to aspect (4) or (5), a unidirectional microphone can be realized through an arithmetic processing performed on the output of an omnidirectional microphone and a bidirectional microphone, which do not require an acoustic delay member. Because the unidirectional microphone can be realized without disposing an acoustic delay member, and with a thickness comparable to that of an omnidirectional microphone, it is possible to introduce a unidirectional directionality pattern into a thin mobile device.

(6) The microphone unit described in aspect (3) may have a delay/gain part for imparting a predetermined delay and a predetermined gain to the difference signal and producing an output; and a second adder for outputting an addition signal that adds the second electrical signal and the output of the delay/gain part. As the configuration of the delay/gain part, there may be contemplated, for example, a configuration including a delay part and a gain part, wherein the gain part is furnished to a stage after the delay part; or a configuration including a delay part and a gain part, wherein the gain part is furnished to a stage before the delay part.

(7) The microphone unit described in aspect (3) may have a delay/gain part for imparting a predetermined delay and a predetermined gain to the second electrical signal and producing an output; and a second adder for outputting an addition signal that adds the difference signal and the output of the delay/gain part.

According to aspect (6) or (7), a unidirectional microphone can be realized through arithmetic processing performed on the output of an omnidirectional microphone and a bidirectional microphone, which do not require an acoustic delay member.

Moreover, through adjustment of the amount of gain or delay of the delay/gain part, it is possible to achieve not only unidirectional directionality, but also directionality patterns of hypercardioid type, supercardioid type, or the like.

Because the unidirectional microphone can be realized without disposing an acoustic delay member, and with a thickness comparable to that of an omnidirectional microphone, it is possible to introduce a unidirectional directionality pattern into a thin mobile device.

(8) In the microphone units described in aspect (4) to (7), either the first electrical signal, the second electrical signal, or the addition signal may be selected and outputted.

According to aspect (8), the unit can be switched between omnidirectional, bidirectional, and unidirectional directionality patterns, according to service conditions.

(9) The microphone units described in aspect (4) to (8) may have an analog-digital converter for sampling the first electrical signal and the second electrical signal at a predetermined frequency, and performing conversion of the signals to digital signals; and the predetermined delay may be a delay that is an integral multiple of the sampling time of the analog-digital converter.

According to aspect (9), by sampling, at a predetermined frequency, the first electrical signal outputted by the first diaphragm and the second electrical signal outputted by the second diaphragm, and converting these to digital signals, it is possible to subsequently perform addition and subtraction processes, as well as a delay process, with good accuracy.

In particular, in a delay process, it is necessary to impart a delay of predetermined duration for all frequencies, making it difficult to perform analog signal processing. In the case of digital signal processing, on the other hand, a delay process can be performed, for example, by shift delay in clock units by employing a shift register, and therefore a highly accurate delay process can be realized.

The delay duration of the delay part may be set, for example, to a duration equal to the distance between the second opening and the third opening, divided by the speed of sound. In this case, a unidirectional directionality pattern of cardioid type can be obtained.

(10) The microphone units described in aspect (4) to (9) may have a first filter for performing a low-pass filter process in which the first electrical signal is inputted, and/or a second filter for performing a low-pass filter process in which the addition signal is inputted.

According to aspect (10), by performing a low-pass filter process on the first electrical signal and the addition signal, which have frequency characteristics of high emphasis type, flat frequency characteristics can be obtained in the voice band.

(11) The microphone units described in aspect (1) or (2) may have a gain part for imparting a predetermined gain to either the first electrical signal or the second electrical signal and producing an output, and an adder for adding the other of the first electrical signal or the second electrical signal and the output of the gain part, and producing an output.

(12) The microphone units described in aspect (1) or (2) may have a first gain part for imparting a predetermined gain to the first electrical signal and producing an output, a second gain part for imparting a predetermined gain to the second electrical signal and producing an output, and an adder for adding the output of the first gain part and the output of the second gain part, and producing an output.

According to aspect (11) or (12), a second electrical signal having an omnidirectional directionality pattern is mixed in a predetermined ratio with a first electrical signal having a bidirectional directionality pattern, thereby improving the sensitivity with respect to a speaker's voice and the signal to noise ratio (SNR), as compared with a bidirectional microphone, as well as minimizing distant noise. In so doing, compatibility with medium distances on the order of 30 to 40 cm is possible. The effect of ameliorating the collapse in sensitivity at the null point can be obtained as well.

(13) In the microphone units described in aspect (11) or (12), either the first electrical signal, the second electrical signal, or the adder output may be selected and outputted.

According to aspect (13), the unit can be switched between omnidirectional, bidirectional, and unidirectional directionality patterns, according to service conditions.

(14) The speech input device according to the present invention may have the microphone unit described in aspect (1) to (13) installed therein. According to aspect (14), there can be realized a speech input device of a thin profile, that minimizes the null points of the directionality of the microphone unit of the speech input device, and that has both background noise minimizing functionality and SNR.

DETAILED DESCRIPTION OF PREFERRED EMBODIMENTS

The preferred embodiments of the present invention are described below with reference to the drawings. However, the present invention is not limited to the embodiments hereinbelow. Any combinations of the content herein are included within the scope of the present invention.

First Embodiment

Figure 1A:
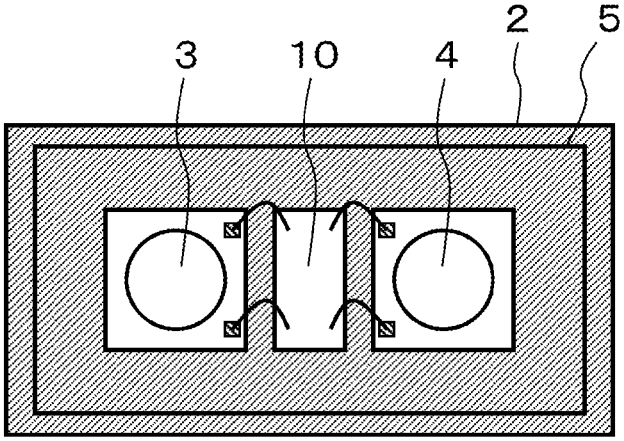
FIG. 1A is a plan view of a microphone unit according to a first embodiment.
Figure 1B:
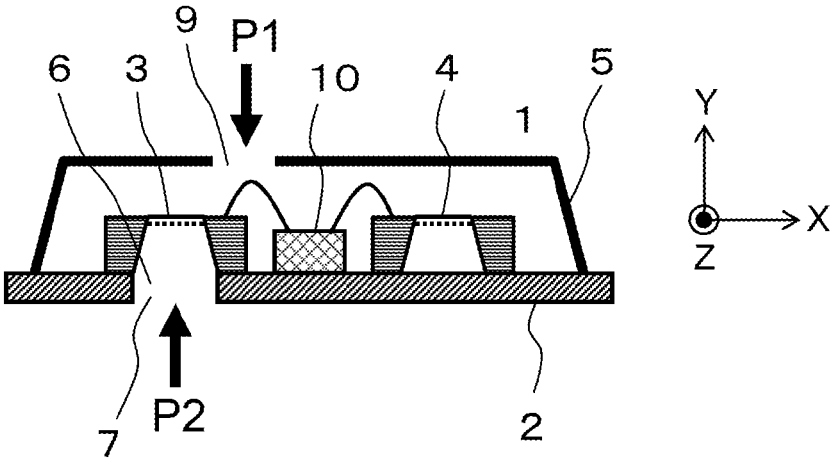
FIG. 1B is a sectional view of the microphone unit according to the first embodiment.

FIG. 1A is a plan view of a microphone unit 1 according to a first embodiment, and FIG. 1B is a diagram schematically representing a sectional view of the microphone unit 1 according to the first embodiment.

The microphone unit 1 according to the first embodiment includes a substrate 2, a first diaphragm 3 for converting an input sound pressure to an electrical signal, and a second diaphragm 4 for converting an input sound pressure to an electrical signal.

A first opening 6 is formed in the top surface of the substrate 2, and a second opening substrate 7 is formed in the bottom surface of the substrate 2. The first opening 6 and the second opening 7 communicate through a sound path in the substrate interior.

The first diaphragm 3 is installed disposed on the top surface of the substrate 2 in such a way as to seal off and obscure the first opening 6. The second diaphragm 4 is installed disposed on the top surface of the substrate 2 in such a way as to seal off a partial region away from the first opening 6 on the top surface of the substrate 2.

During installation of the first diaphragm 3 and the second diaphragm 4 on the substrate 2, it is necessary for the substrate 2 and support parts supporting the first diaphragm 3 and the second diaphragm 4 to be bonded air-tightly, in such a way that no air leaks that could affect the acoustic characteristics occur. In preferred practice, an adhesive having a stress absorbing effect will be used, so that the first diaphragm 3 and the second diaphragm 4 are not subjected to mechanical stresses from the substrate 2, causing the tensile force of the diaphragms to fluctuate. Epoxy adhesives, silicone adhesives, or the like could be employed as such an adhesive.

The microphone unit 1 in the present embodiment includes a cover 5 for covering the first diaphragm 3 and the second diaphragm 4. The cover 5 is joined air-tightly to the outside edge of the substrate 2, forming an internal space. A third opening 9 is formed in the cover 5, and the internal space communicates with the outside space via the third opening 9.

Here, because sound pressure P1 inputted from the third opening 9 impinges on the top surface of the first diaphragm 3, and sound pressure P2 inputted from the second opening 7 impinges on the bottom surface of the first diaphragm 3, an electrical signal that reflects the differential pressure (P1−P2) is outputted from the first diaphragm 3. Specifically, the first diaphragm 3 functions as a bidirectional microphone that has a figure "8" directionality pattern.

Additionally, because sound pressure P1 inputted from the third opening 9 impinges on the top surface of the second diaphragm 4, and a constant baseline pressure impinges on the bottom surface of the second diaphragm 4 by virtue of being a closed space, an electrical signal that reflects P1 is outputted from the second diaphragm 4. Specifically, the second diaphragm 4 functions as an omnidirectional microphone having a circular directionality pattern.

The microphone unit 1 in the present embodiment includes a signal processor 10 for performing arithmetic operations on the output signal of the first diaphragm 3 and the output signal of the second diaphragm 4, inside the internal space. The signal processor 10 is constituted, for example, by a semiconductor chip that includes an integrated circuit (IC).

Electrical connections among the first diaphragm 3, the second diaphragm 4, and the signal processor 10 are made, for example, by furnishing electrode terminals on the top surfaces of the first diaphragm 3, the second diaphragm 4, and the signal processor 10, and connecting the electrode terminals to one another by wire bonding.

Alternatively, it is possible to furnish electrode terminals on the bottom surfaces of the first diaphragm 3, the second diaphragm 4, and the signal processor 10; and to mount a flip chip over a wiring pattern which has been formed, in opposition to the electrode terminals, on the top surface of the substrate 2, and make electrical connections therebetween.

A signal on which an arithmetic operation has been performed by the signal processor 10 is transmitted from the signal processor 10 to the wiring pattern on the top surface of the substrate 2, and, via internal wiring of the substrate 2, reaches an electrode part (not shown) on the bottom surface of the substrate 2. Routing of the signal from the signal processor 10 to the wiring pattern on the top surface of the substrate 2 can be accomplished, for example, in the above manner, through connection by wire bonding or flip chip mounting in the aforedescribed manner.

As the substrate 2, it is preferable to use a printed circuit board substrate on which it is possible to form wiring patterns on the substrate surfaces. For example, a substrate such as a glass epoxy substrate, a ceramic substrate, a polyimide film substrate, or the like can be used.

In order to prevent the microphone unit 1 from being affected by noise due to external electromagnetic waves, it is preferable for the cover 5 to be constituted of a conductive metal material, and to be connected to a fixed potential, such as the ground of the substrate 2. Alternatively, as shown in FIG. 2, the substrate 2 may be covered with a cover 5 that includes a structure of a non-conductive material, and a shield cover 8 made of metal then installed covering the cover 5.

Figure 2A:
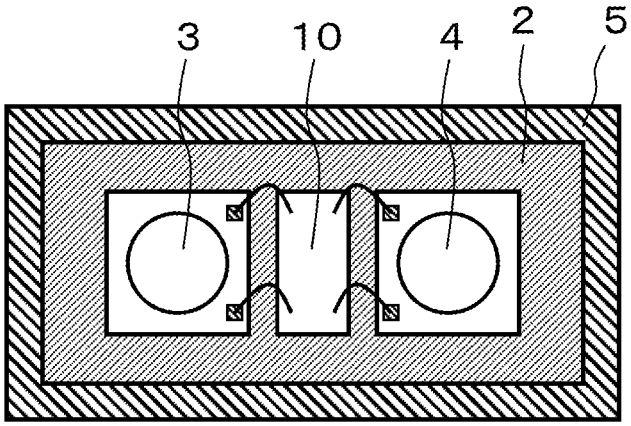
FIG. 2A is a plan view of the microphone unit according to the first embodiment.
Figure 2B:
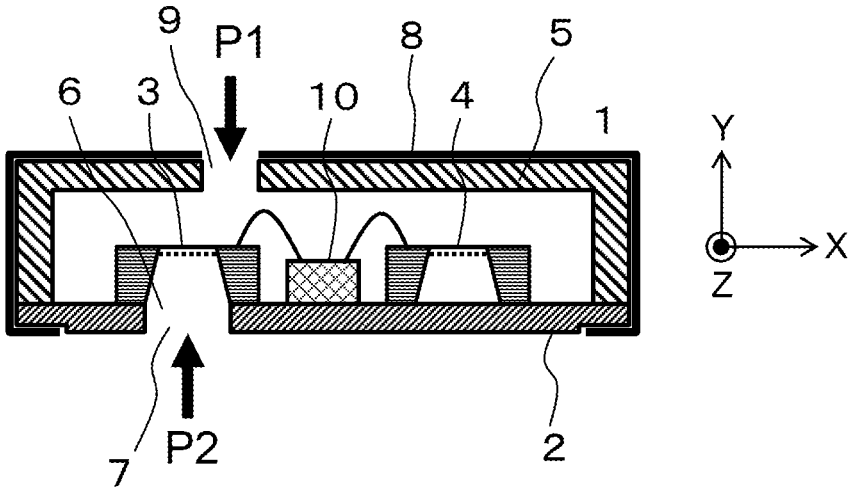
FIG. 2B is a sectional view of the microphone unit according to the first embodiment.

In a case in which the cover 5 is covered by the metal shield cover 8, as shown in FIG. 2A and FIG. 2B, in order to connect the shield cover 8 to a fixed potential, the end of the shield cover 8 may be crimped at the bottom surface of the substrate 2, with this crimped portion functioning as an electrode. When the microphone unit 1 is mounted onto a mounting substrate (not shown in FIG. 2A or FIG. 2B), the effect of an electromagnetic shield can be enhanced by soldering the crimped portion, to join it to the ground of the mounting substrate.

First Modification Example

In order to maximize the distance decay rate of a bidirectional microphone, specifically, to maximize the effect of minimizing distant noise, it is necessary to design the figure "8" directionality pattern to have good symmetry.

To this end, it is preferable to adopt a configuration whereby the propagation distance d1 of sound from the second opening 7 of the microphone unit 1 to the bottom surface of the first diaphragm, and the propagation distance d2 of sound from the from the third opening 9 to the top surface of the first diaphragm 3, are equal.

In FIG. 1A and FIG. 1B, or FIG. 2A and FIG. 2B, the second opening 7 is directly below the first diaphragm 3, and therefore in order to minimize the difference between the propagation distance d1 and the propagation distance d2, there was no other option but to bring the third opening 9 close to right above the first diaphragm 3.

In a case in which the first diaphragm 3 is below the third opening 9, there is a high probability of dust and dirt infiltrating from the outside through the third opening 9 and becoming deposited on the first diaphragm 3, posing a risk of lowering the sensitivity of the microphone, or causing a malfunction. Consequently, it is preferable for the third opening 9 to be disposed as far away as possible from the upper side of the first diaphragm 3.

Figure 3:
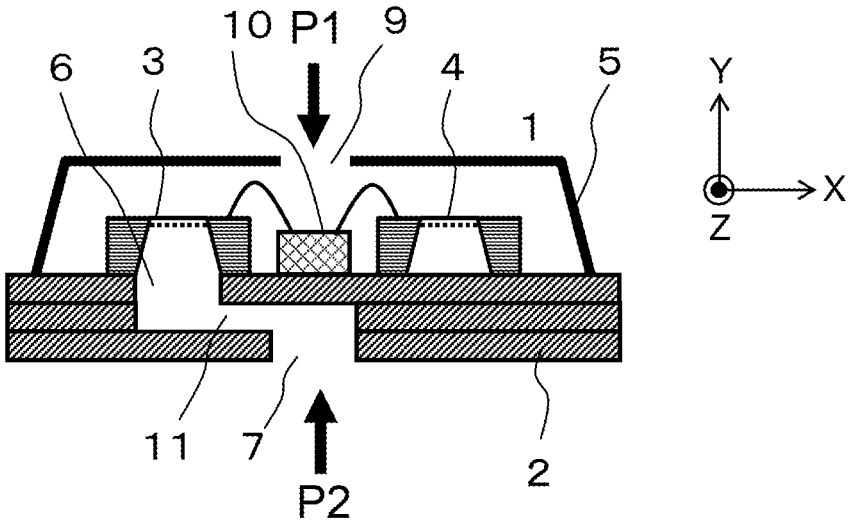
FIG. 3 is a sectional view of a microphone unit according to a first modification example.

For example, as with the microphone unit 1 shown in sectional view in FIG. 3, the third opening 9 may be disposed such that it does not lie above the first diaphragm 3 and the second diaphragm 4, so that any dust or dirt infiltrating from the outside through the third opening 9 will not be deposited on the first diaphragm 3 and the second diaphragm 4.

However, as shown in FIG. 3, in a case in which the third opening 9 is formed at an offset from above the first diaphragm 3, because the propagation distance d2 from the third opening 9 to the top surface of the first diaphragm 3 is longer, it will be necessary to lengthen the propagation distance d1 from the second opening 7 to the bottom surface of the first diaphragm, in order for the propagation distance d1 and the propagation distance d2 to be equal to one another.

For example, as shown in FIG. 3, the second opening 7 formed in the bottom surface of the substrate 2 may be disposed at an offset in a direction parallel to the substrate surfaces, with respect to the first opening 6 formed in the top surface of the substrate 2, and a hollow layer 11 may be formed extending in a direction parallel to the substrate surfaces through an interior layer of the substrate 2 to provide communication from the first opening 6 to the second opening 7 via the hollow layer 11, thereby making the propagation distance d1 and the propagation distance d2 equal to one another.

Figure 4:
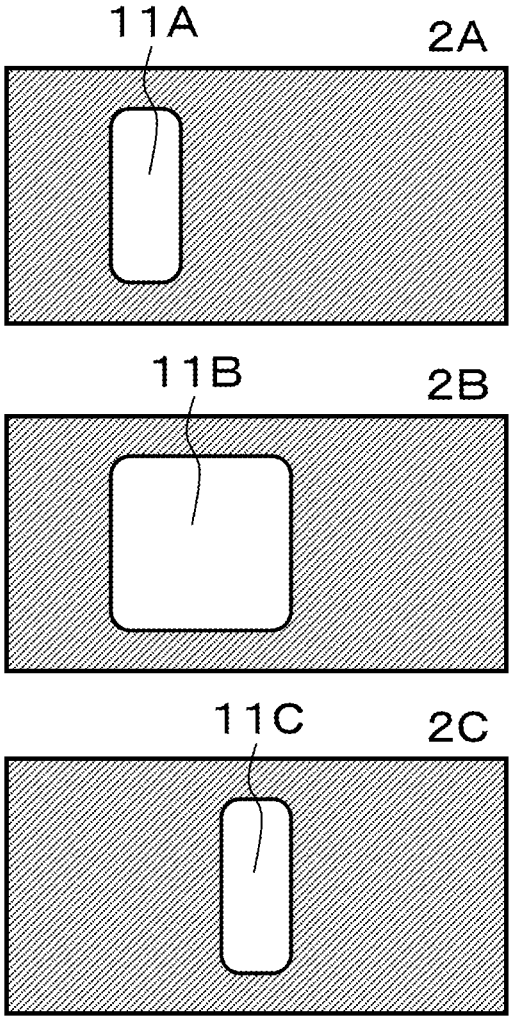
FIG. 4 is a layer configuration diagram of a substrate of the microphone unit according to the first modification example.

Formation of the hollow layer 11 of the substrate 2 can be accomplished, for example, by forming the substrate 2 having the hollow layer 11 as shown in FIG. 4, through stacking and bonding together, in order from the bottom, a first substrate layer 2C in which a first substrate layer opening 11C is formed passing through from the front surface to the back surface of the first substrate layer, a second substrate layer 2B in which a second substrate layer opening 11B is formed passing through from the front surface to the back surface of the second substrate layer, and a third substrate layer 2A in which a third substrate layer opening 11A is formed passing through from the front surface to the back surface of the third substrate layer.

The thickness of the respective substrate layers must be determined in consideration of the strength of the substrate 2, the acoustic impedance of the hollow layer 11, and so on. In order to prevent degradation of acoustic propagation characteristics, it is necessary for the thickness of the hollow layer 11 to be 0.1 mm or greater.

By adopting such a configuration, the figure "8" directionality pattern can have good symmetry, and the effect of minimizing distant noise can be maximized.

Second Modification Example

Figure 5:
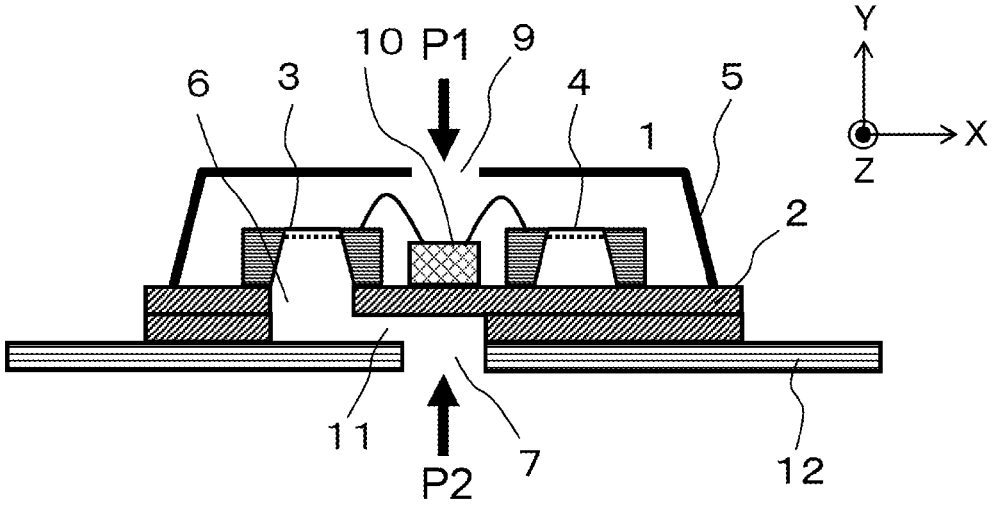
FIG. 5 is a sectional view of a microphone unit according to a second modification example.

In the first modification example, a configuration in which the hollow layer 11 is formed in the substrate 2 was shown; however, due to the need to stack three substrates as shown in FIG. 4, the overall thickness is increased. In this regard, it would be acceptable to instead adopt a configuration, such as that shown in FIG. 5 for example, in which the substrate 2 is constituted by a second substrate layer 2B and a third substrate layer 2A stacked and bonded in that order from the bottom, and an intermediate layer 11 is formed inside the substrate 2 and the mounting substrate 12 when the substrate 2 is mounted on the mounting substrate 12. By adopting such a configuration, the number of substrates constituting the substrate 2 can be reduced, making possible a thinner profile.

Figure 6:
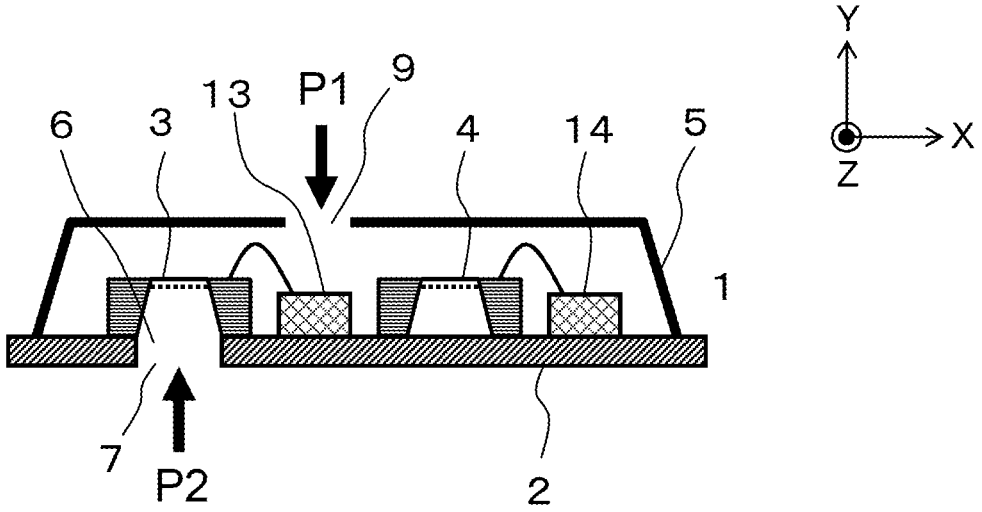
FIG. 6 is a sectional view of the microphone unit according to the first embodiment.

Whereas the present embodiment and modification examples thereof showed examples in which the signal processor 10 is constituted by a single chip, it may be constituted by a plurality of chips as well. For example, a configuration in which, as shown in FIG. 6, a first amplifier 13 for amplifying the electrical signal outputted by the first diaphragm 3, and a second amplifier 14 for amplifying the electrical signal outputted by the second diaphragm 4, are separated.

By adopting such a configuration, crosstalk between the electrical signal outputted by the first diaphragm 3 and the electrical signal outputted by the second diaphragm 4 can be reduced.

Furthermore, some or all of the processing by the signal processor 10 may be accomplished through processing externally to the microphone unit 1. It is also possible for some or all of the processing by the signal processor 10 to be performed through software processing. In this case, the microphone unit 1 and the external processor taken as a whole would function as the speech processing system.

First Configuration Example of Signal Processor

Figure 7A:
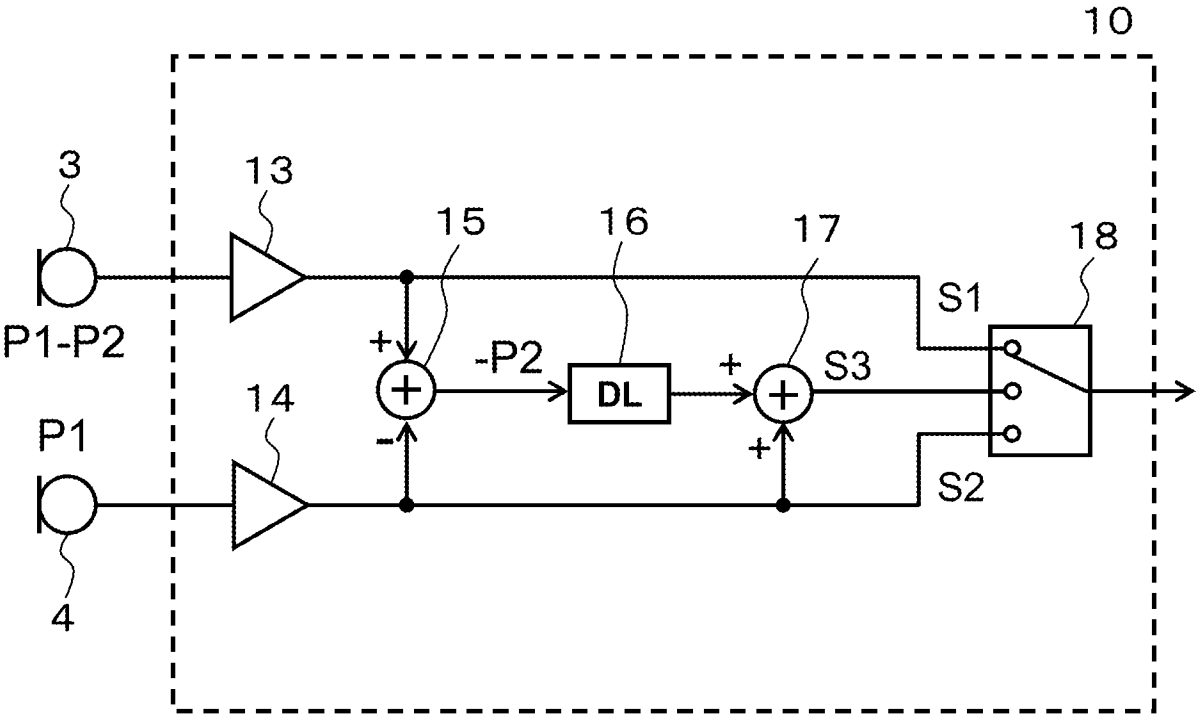
FIG. 7A is a diagram showing arithmetic processing according to a first configuration example of a signal processor.

FIG. 7A shows a first configuration example of the signal processor 10, including the connective relationship between the first diaphragm 3 and the second diaphragm 4.

The signal processor 10 includes a first adder 15 for outputting a difference signal that subtracts the electrical signal S2 outputted by the second diaphragm 4 from the first electrical signal S1 outputted by the first diaphragm 3; a delay part 16 that outputs a delay signal in which a predetermined delay is imparted to the difference signal; and a second adder 17 for outputting an addition signal that adds the second electrical signal S2 and the delay signal.

Herein, an arrangement whereby, as shown in FIG. 7A, once the first electrical signal S1 outputted by the first diaphragm 3 is amplified by the first amplifier 13, and the second electrical signal S2 outputted by the second diaphragm 4 is amplified by the second amplifier 14, in the arithmetic processing, the amplified signal outputted by the first amplifier 13 is taken to be the first electrical signal S1, and the amplified signal outputted by the second amplifier 14 is taken to be the second electrical signal S2, is also acceptable. In a case in which the signals outputted by the first diaphragm 3 and the second diaphragm 4 have high output impedance, it will be preferable to perform current amplification before processing. By amplifying the first electrical signal S1 and the second electrical signal S2 separately as shown in FIG. 7A, crosstalk between the first electrical signal S1 and the second electrical signal S2 can be reduced.

The first adder 15 subtracts the second electrical signal S2=(P1) outputted by the second diaphragm 4 from the first electrical signal S1=(P1−P2) outputted by the first diaphragm 3, and thereby obtains a difference signal corresponding to (−P2). In the delay part 16, a delay signal (−P2·D) in which the signal corresponding to (−P2) is delayed by a delay of predetermined duration is generated. In the second adder 17, the second electrical signal S2=(P1) and the delay signal (−P2·D) are added, and an addition signal S3=(P1−P2·D) is outputted.

The delay duration of the delay part 16 is set, for example, to a duration equal to the distance between the second opening 7 and the third opening 9, divided by the speed of sound. In this case, a unidirectional directionality pattern of cardioid type can be obtained.

Figure 8:
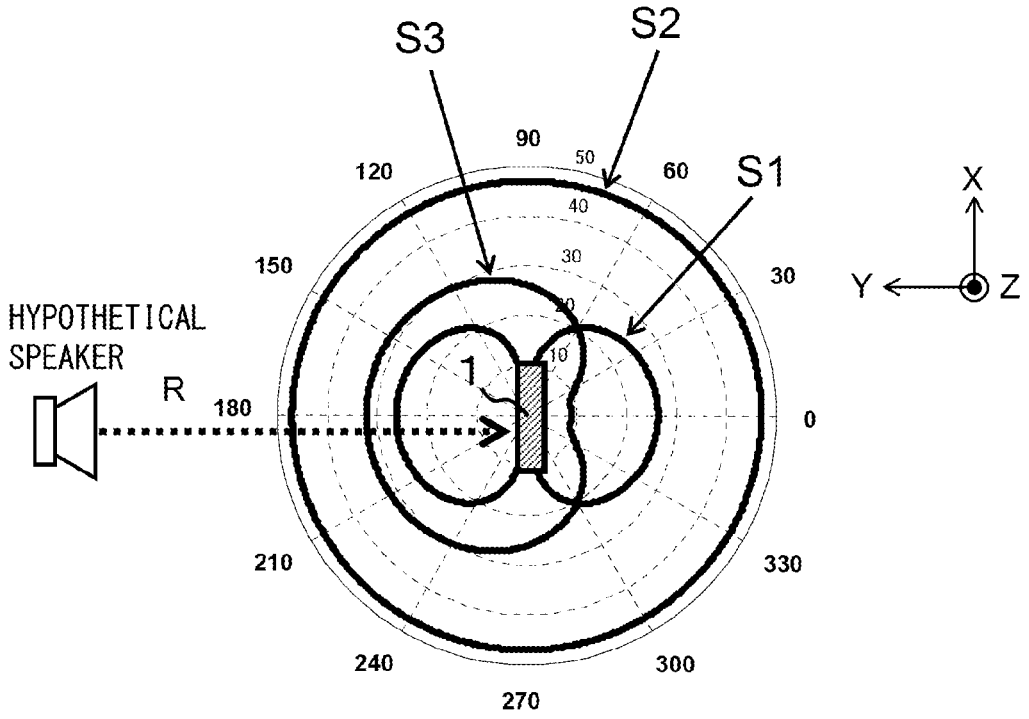
FIG. 8 is a diagram showing a directional characteristic pattern of the microphone unit according to the first embodiment.

As shown in FIG. 8, depending on the orientation of the sound source, the first electrical signal S1 outputted by the first diaphragm 3, the second electrical signal S2 outputted by the second diaphragm 4, and the addition signal S3 respectively take on the directionality pattern of a bidirectional microphone in the case of S1, the directionality pattern of an omnidirectional microphone in the case of S2, and the directionality pattern of a unidirectional microphone in the case of S3. S2 has the highest sensitivity with respect to the direction of a hypothetical speaker, while S1 has the lowest. The sensitivity of S3 falls between that of S1 and S2.

Figure 9:
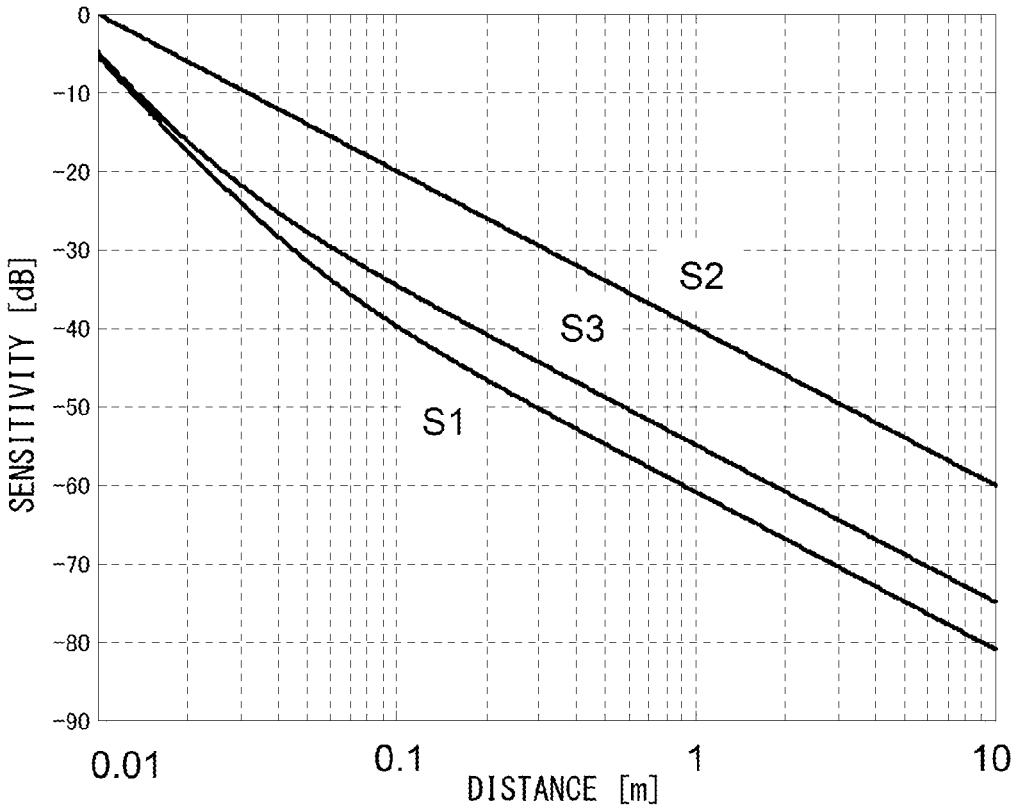
FIG. 9 is a diagram showing distance decay characteristics of the microphone unit according to the first embodiment.

FIG. 9 shows an example of the decay characteristics of the respective signals S1, S2, and S3, with respect to the distance between the sound source and the microphone. S2 shows a characteristic that decays in inverse proportion to distance. S1 has the best distance decay characteristic, while the characteristic of S3 falls between those of S1 and S2.

Utilizing these differences in characteristics, the system can be used while switching among omnidirectional, bidirectional, and unidirectional directionality patterns, according to particular applications or service conditions. In a mobile terminal, the optimum directionality pattern can be changed according to service conditions, such as (1) close talking at a near distance position (about 5 cm), (2) a hands-free call at a far distance position (about 50 cm), (3) speech recognition at an intermediate distance position (about 30 cm), or the like.

Possible service methods are, for example: (i) during close talking, the signal S1 is selected to switch to bidirectional directionality pattern, to collect the speech of a nearby speaker and minimize distant noise; (ii) during a hands-free call, the signal S2 is selected to switch to omnidirectional directionality pattern, to collect sound from all orientations; and (iii) in the case of speech recognition while viewing the screen of a mobile terminal, the signal S3 is selected to switch to unidirectional directionality pattern, to ensure sensitivity in the beam orientation, while minimizing noise from unwanted orientations.

Typically, when an omnidirectional microphone and a bidirectional microphone are compared, the omnidirectional microphone has a higher SNR. The noise level of a microphone is determined by the circuit noise of the sense amplifier, and the level is substantially the same for the omnidirectional microphone and the bidirectional microphone. In contrast to this, in relation to the signal level of the microphone, in the case of the omnidirectional microphone, sound pressure P1 inputted from the sound hole is detected and converted to an electrical signal, whereas in the case of the bidirectional microphone, the differential pressure of sound pressure P1 and sound pressure P2 inputted from nearby sound holes is detected and converted to an electrical signal, and therefore the signal amplification (signal level) of the bidirectional microphone is lower than that of the omnidirectional microphone.

Additionally, when the SNR during use of the microphone is considered, because the input sound pressure is lower for a far distance than for a near distance between the sound source and the microphone, the signal amplification is lower, and the SNR is lower, creating disadvantageous conditions. Consequently, in a case of capturing a sound source at a far distance, it is preferable to use a microphone having the best possible sensitivity, and in this respect, the omnidirectional microphone is superior.

However, in a case of service in an environment in which there is background noise, because the omnidirectional microphone captures sound from all orientations, the collected sound includes background noise in addition to the speech of the speaker intended for collection. On the other hand, whereas the low sensitivity of the bidirectional microphone is disadvantageous in terms of the SNR, it has a directionality pattern adapted to capture sound from a specific orientation, as well as high distance decay effect, and as such has outstanding effect in minimizing background noise.

Consequently, in case of switching among omnidirectional, bidirectional, and unidirectional directionality patterns according to applications and service conditions, it is necessary to make determinations in terms of overall performance, taking into consideration not only the beam orientation, but also the SNR, background noise, and other characteristics.

Here, the signal processor 10 may independently output the three respective signals, i.e., (i) the first electrical signal S1 outputted by the first diaphragm 3, (ii) the second electrical signal S2 outputted by the second diaphragm 4, and (iii) the addition signal S3, and it would also be acceptable to have a switching part 18 select the three signals for output, as shown in FIG. 7A.

With the microphone unit according to the present embodiment, sound inputted to the first diaphragm 3 and the second diaphragm 4 from the third opening 9, which serves as a common sound hole, is transmitted at identical pressure to both of the diaphragms; therefore, by performing a mutual arithmetic operation on the first electrical signal S1=(P1−P2) outputted by the first diaphragm 3 and the second electrical signal S2=(P1) outputted by the second diaphragm 4, the signal that corresponds to the pressure transmitted to the top surface of the first diaphragm 3 is completely cancelled out, and the signal (P2) that corresponds to the pressure transmitted to the bottom surface of the first diaphragm 3 can be isolated and extracted.

Herein, it is very important for the input sound hole to be common to the first diaphragm 3 and the second diaphragm 4; and because errors due to spatial displacement of the input sound hole do not occur, the signal transmitted to the top surface of the first diaphragm 3 can be completely canceled out.

On the other hand, in a case in which the first diaphragm 3 and the second diaphragm 4 are individually furnished with input sound holes, despite being adjacently disposed, amplitude errors and/or phase errors occur due to spatial displacement in position, and therefore, the signal transmitted to the top surface of the first diaphragm 3 cannot be completely canceled out.

Figure 35:
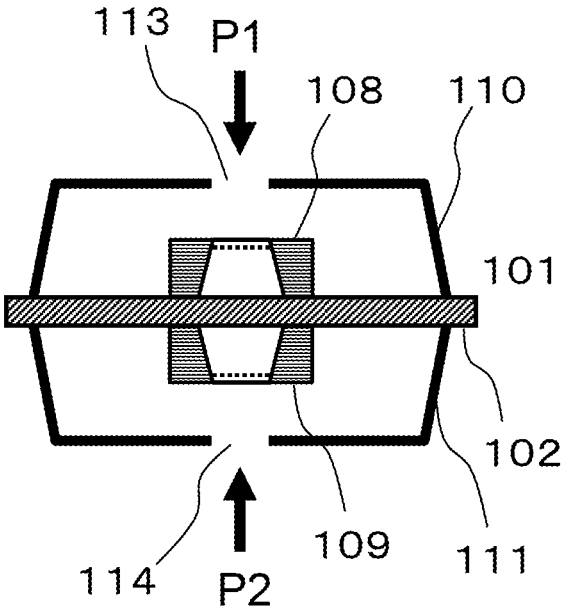
Related Art FIG.35
FIG. 35 is a sectional view of a microphone according to the related art.

By isolating and extracting the signal (P2) that corresponds to the pressure transmitted to the bottom surface of the first diaphragm 3, a process that is the equivalent of a microphone unit having two microphones disposed on the top surface and the bottom surface of the substrate 2 (see FIG. 35) can be realized. Moreover, because it is unnecessary to dispose an acoustic delay member, it is possible for the characteristics of a unidirectional microphone to be realized, while achieving thickness equal to that of an omnidirectional microphone. With the microphone unit 1 according to the present embodiment, it is possible to install a microphone in a thin-profile portable device without increasing the thickness of the microphone, and to realize the directionality pattern of a unidirectional microphone.

Figure 10A:
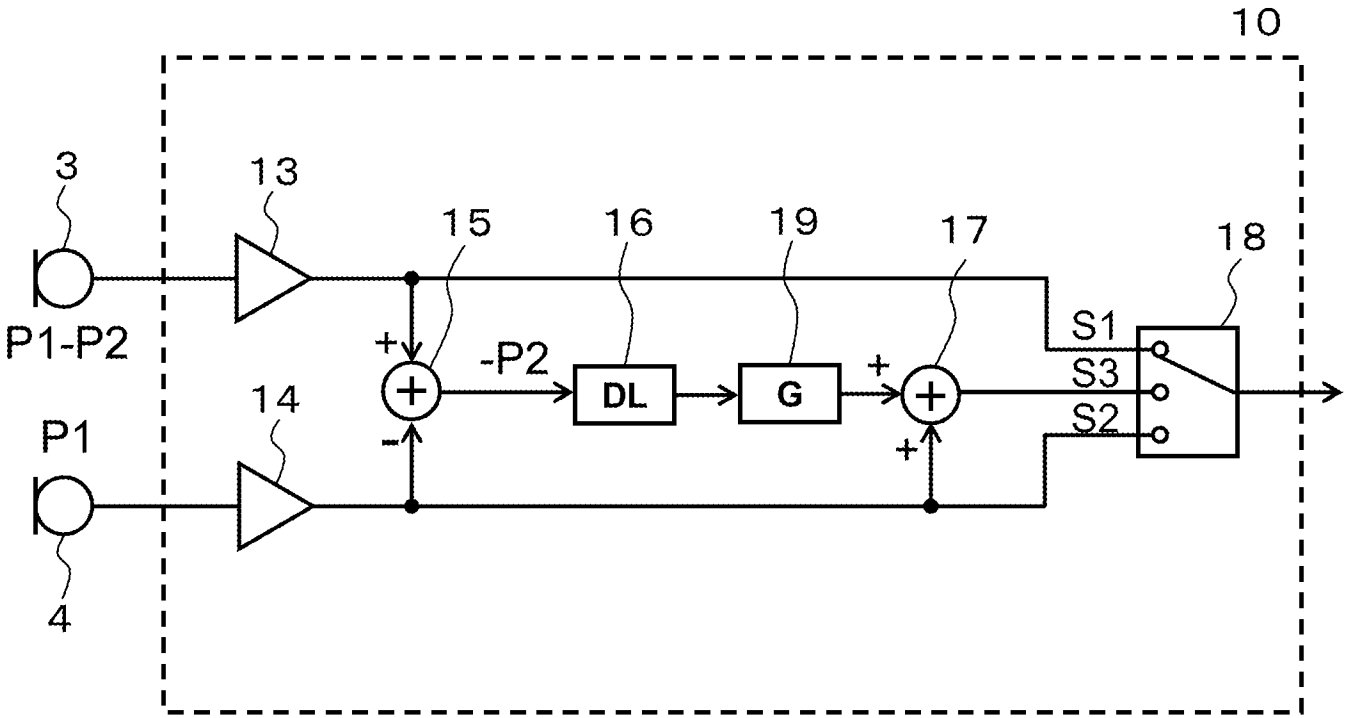
FIG. 10A is a diagram showing an arithmetic processing of a signal processor that includes a gain part.

The delay part 16 generates a signal (−P2·D) that delays the signal corresponding to (−P2) by a delay of predetermined duration; an arrangement whereby variable control of this amount of delay is enabled is acceptable. Also acceptable is an arrangement as shown in FIG. 10A, whereby variable control of the amplitude of the signal (−P2·D) is enabled, by having a gain part 19 in a stage before or a stage after the delay part 16.

In so doing, the amount of delay of the delay part 16, and the gain of the gain part 19, can be adjusted, making it possible to form not only unidirectional directionality, but also various other directionality patterns, such as those of hypercardioid type, supercardioid type, or the like.

Figure 11A:
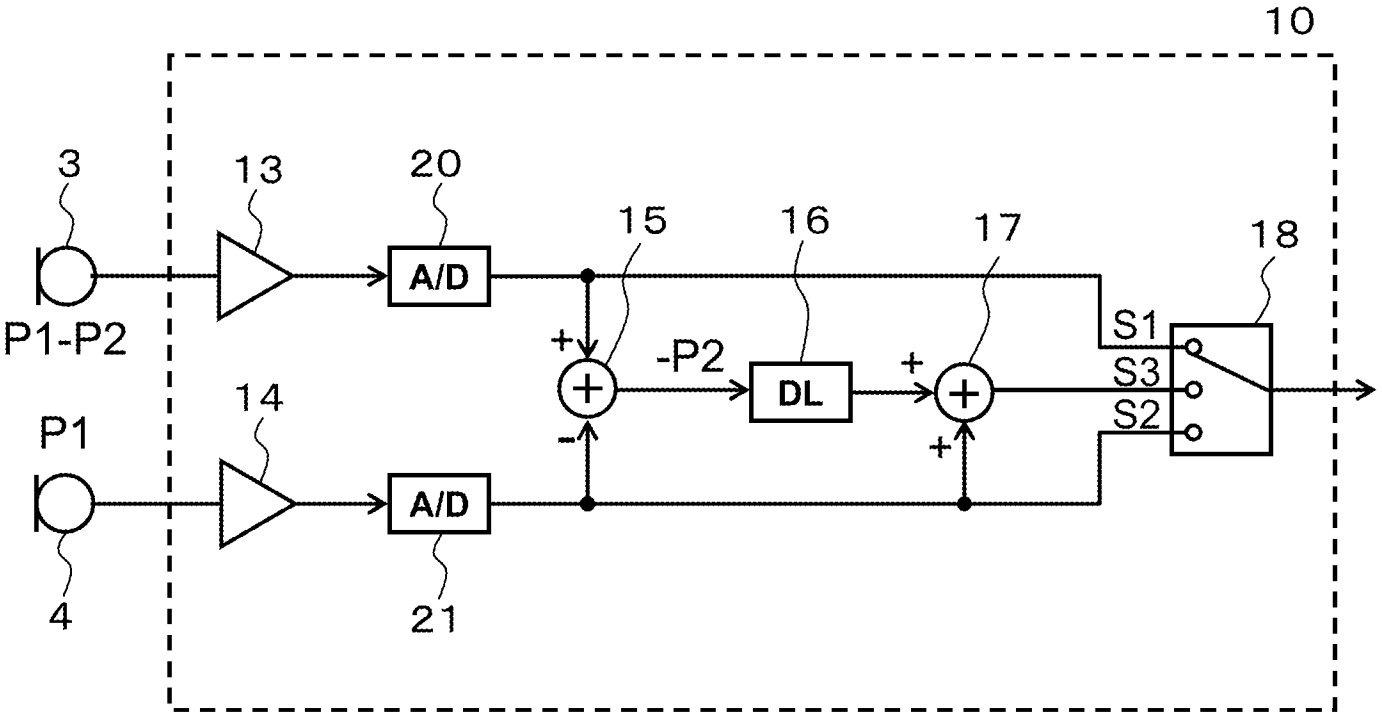
FIG. 11A is a diagram showing an arithmetic processing of a signal processor that includes an AD converter.

In another acceptable arrangement shown in FIG. 11A, the signal processor 10 has analog-digital converters 20, 21 for sampling at a predetermined frequency the first electrical signal S1 which is the analog signal outputted by the first diaphragm 3, and the second electrical signal S2 which is the analog signal outputted by the second diaphragm 4, and converting these to first and second electrical signals S1, S2 which are digital signals; and the delay part 16 delays the difference signal (−P2) by an integral multiple of the sampling duration.

By sampling at a predetermined frequency the first electrical signal S1 which is the analog signal outputted by the first diaphragm 3, and the second electrical signal S2 which is the analog signal outputted by the second diaphragm 4, and converting these to first and second electrical signals S1, S2 which are digital signals, it is possible for subsequent addition and subtraction processes, as well as delay processes, to be performed with good accuracy.

In particular, in a delay process, it is necessary to impart a delay of predetermined duration for all frequencies, making it difficult to perform analog signal processing. In the case of digital signal processing, on the other hand, a delay process can be performed, for example, through shift delay in clock units for all frequencies by employing a shift register, and therefore highly accurate delay processing can be realized.

Figure 12A:
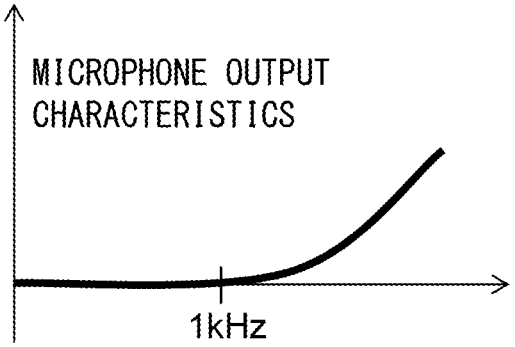
FIG. 12A is a microphone output characteristic diagram for describing frequency correction of a signal S1.
Figure 12B:
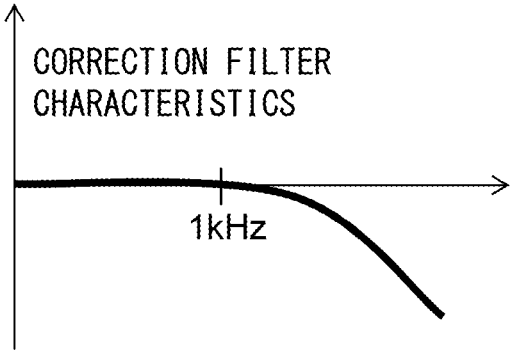
FIG. 12B is a correction filter characteristics diagram for describing frequency correction of a signal S1.
Figure 12C:
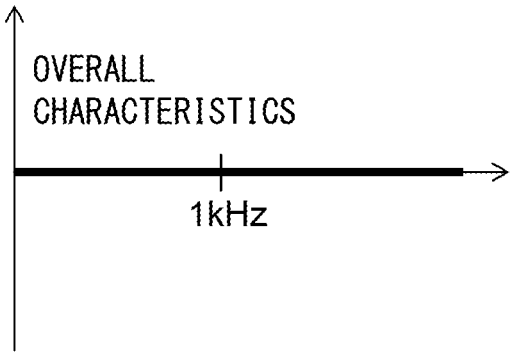
FIG. 12C is an overall characteristics diagram for describing frequency correction of a signal S1.
Figure 13A:
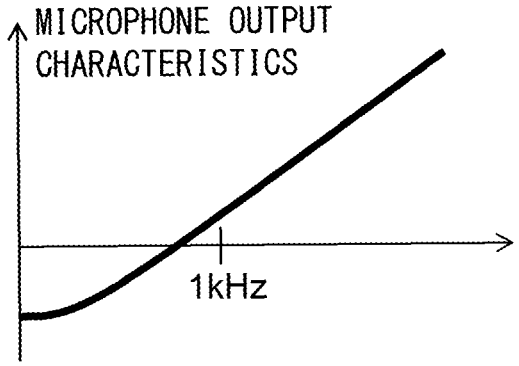
FIG. 13A is a microphone output characteristics diagram for describing frequency correction of a signal S2.
Figure 13B:
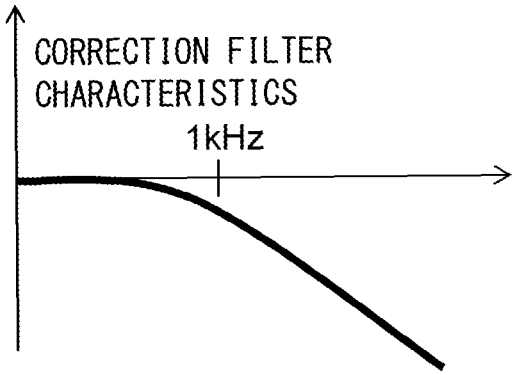
FIG. 13B is a correction filter characteristics diagram for describing frequency correction of a signal S2.
Figure 13C:
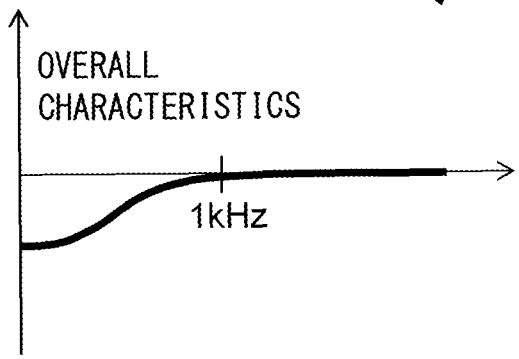
FIG. 13C is an overall characteristics diagram for describing frequency correction of a signal S2.

In the present embodiment, in a case in which the signal S1 is used with a sound source situated a near distance on the order of 5 cm from the microphone unit 1 according to the present embodiment, the frequency characteristics show the characteristics of a high-pass filter, whereby the gain increases at an initial dip from around 1.5 kHz, as shown in FIG. 12A to FIG. 12C. In a case in which the signal S3 is used with a sound source situated an intermediate distance on the order of 30 to 40 cm from the microphone unit 1 according to the present embodiment, the frequency characteristics show the characteristics of a high-pass filter, whereby the gain increases at an initial dip from around 100 Hz, as shown in FIG. 13A to FIG. 13C.

Figure 14A:
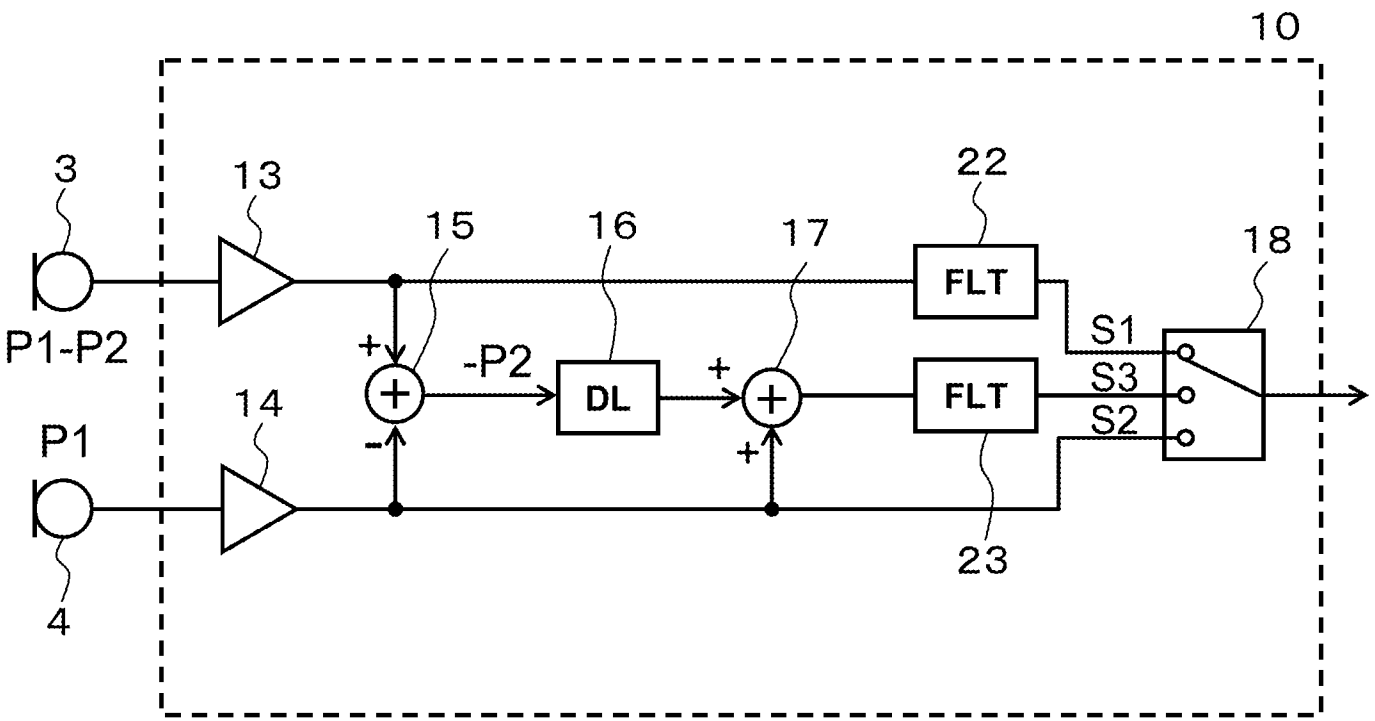
FIG. 14A is a diagram showing an arithmetic processing according to the first embodiment, of a signal processor that includes a frequency correction filter.

In a case in which the speech of a speaker is to be collected faithfully, it is preferable for the frequency characteristics to be basically flat. Consequently, it would be acceptable for the signal processor 10 to include at least a first filter 22 and/or a second filter 23 for flattening the frequency characteristics of the signal S1 or the signal S3, as shown in FIG. 14A.

For example, by adopting a low-pass filter with a cutoff frequency of 1.5 kHz as the first filter 22 of the signal S1 to compensate for the high-pass filter characteristics of the signal S1, flat frequency characteristics can be realized. By adopting a low-pass filter with a cutoff frequency of 300 Hz as the first filter 22 of the signal S3 to compensate for the high-pass filter characteristics of the signal S3, flat frequency characteristics can be realized in the speech band (300 Hz to 4 kHz).

Second Configuration Example of Signal Processor

Figure 15A:
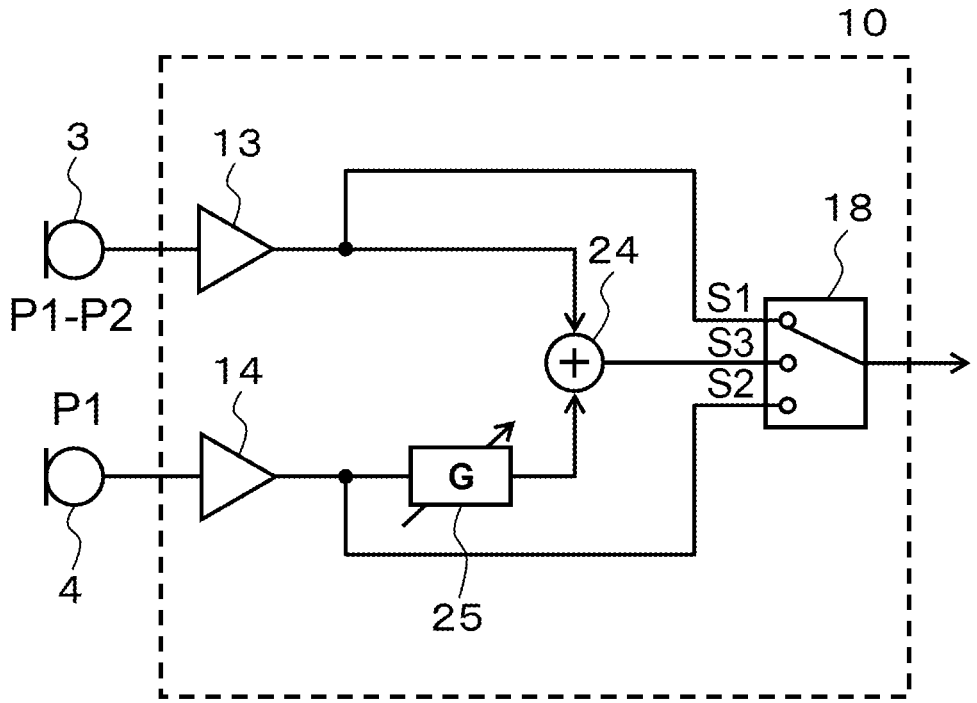
FIG. 15A is a diagram showing an arithmetic processing according to a second configuration example of a signal processor.

FIG. 15A is a diagram showing a second configuration example of the signal processor 10, and includes the connection relationships with the first diaphragm 3 and the second diaphragm 4.

The signal processor 10 has a gain part 25 for imparting a predetermined gain G to the second electrical signal outputted by the second diaphragm 4, and outputting the signal; and an adder 24 for adding the first electrical signal outputted by the first diaphragm 3 and the signal outputted by the gain part 25.

Here, an arrangement whereby, as shown in FIG. 15A, once the first electrical signal outputted by the first diaphragm 3 is amplified by the first amplifier 13, and the second electrical signal outputted by the second diaphragm 4 is amplified by the second amplifier 14, in the arithmetic processing, the amplified signal outputted by the first amplifier 13 is taken to be the first electrical signal S1, and the amplified signal outputted by the second amplifier 14 is taken to be the second electrical signal S2, is also acceptable. In a case in which the signals outputted by the first diaphragm 3 and the second diaphragm 4 have high output impedance, it will be preferable to perform current amplification before processing. By amplifying the first electrical signal S1 and the second electrical signal S2 separately as shown in FIG. 15A, crosstalk between the first electrical signal S1 and the second electrical signal S2 can be reduced.

In the gain part 25, a predetermined gain G is imparted to the electrical signal S2=(P1) outputted by the second diaphragm 4, to generate a signal (G·P1). In the adder 24, the electrical signal S1=(P1−P2) outputted by the first diaphragm 3 and the signal (G·P1) are added together, and an addition signal S3=(P1−P2+G·P1)=((1+G)P1−P2) is outputted.

Figure 16:
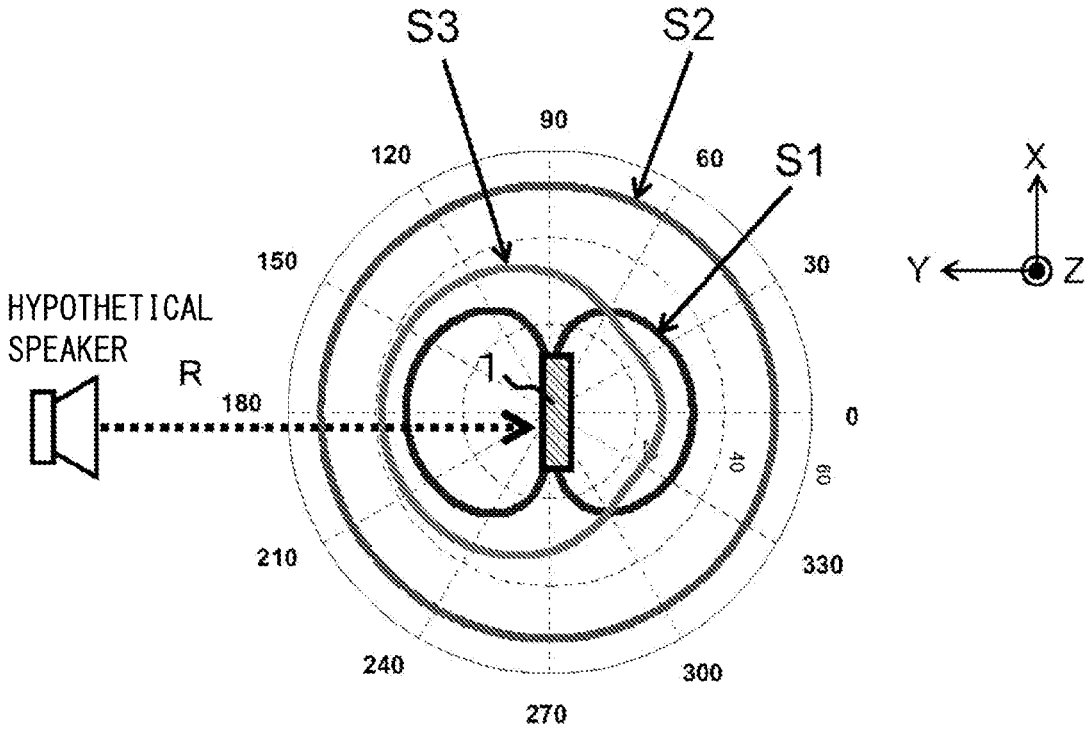
FIG. 16 is a diagram showing a directional characteristic pattern of the microphone unit according to the first embodiment.

As shown in FIG. 16, depending on the orientation of the sound source, the first electrical signal S1 outputted by the first diaphragm 3, the second electrical signal S2 outputted by the second diaphragm 4, and the addition signal S3 respectively take on the directionality pattern of a bidirectional microphone in the case of S1, the directionality pattern of an omnidirectional microphone in the case of S2, or a directionality pattern approximating a unidirectional microphone in the case of S3. S2 has the highest sensitivity with respect to the direction of a hypothetical speaker, while S1 has the lowest. The sensitivity of S3 falls between that of S1 and S2.

The directionality pattern of the signal S3 can be controlled by changing the gain G. When G=0, the signal S3 takes on the directionality pattern of a bidirectional microphone; for example, when G=0.1, it takes on a directionality pattern approximating a unidirectional microphone, as shown in FIG. 16. S3 of FIG. 16 shows the directionality pattern when the frequency is 1 kHz, and the microphone-to-sound source distance is 40 cm. Herein, the high-sensitivity orientation is preferably designed to be the direction of the hypothetical speaker.

Typically, when an omnidirectional microphone and a bidirectional microphone are compared, the omnidirectional microphone has a higher SNR. The noise level of a microphone is determined by the circuit noise of the sense amplifier, and the level is substantially the same for the omnidirectional microphone and the bidirectional microphone. In contrast to this, in relation to the signal level of the microphone, in the case of the omnidirectional microphone, sound pressure P1 inputted from the sound hole is detected and converted to an electrical signal, whereas in the case of the bidirectional microphone, the differential pressure of sound pressure P1 and sound pressure P2 inputted from nearby sound holes is detected and converted to an electrical signal, and therefore the signal amplification (signal level) of the bidirectional microphone is lower than that of the omnidirectional microphone.

Additionally, when the SNR during use of the microphone is considered, because the input sound pressure is lower for a far distance than for a near distance between the sound source and the microphone, the signal amplification is lower, and the SNR is lower, creating disadvantageous conditions. Consequently, in a case of capturing a sound source at a far distance, it is preferable to use a microphone having the best possible sensitivity, and in this respect, the omnidirectional microphone is superior.

However, in a case of service in an environment in which there is background noise, because the omnidirectional microphone captures sound from all orientations, the collected sound includes background noise in addition to the speech of the speaker intended for collection. On the other hand, whereas the low sensitivity of the bidirectional microphone is disadvantageous in terms of the SNR, it has a directionality pattern adapted to capture sound from a specific orientation, as well as high distance decay effect, and as such has outstanding effect in minimizing background noise.

Figure 17:
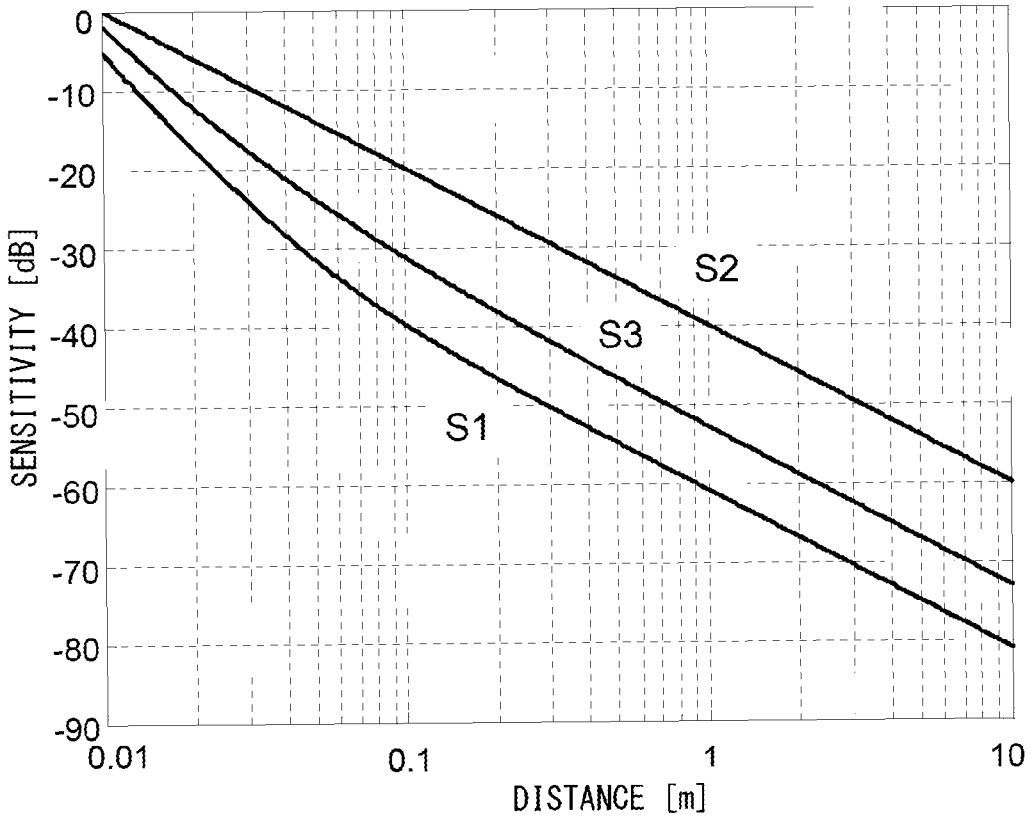
FIG. 17 is a diagram showing distance decay characteristics of the microphone unit according to the first embodiment.

FIG. 17 shows an example of decay characteristics with respect to distance between the sound source and the microphone, for the signals S1, S2, and S3 respectively. S2 shows the distance decay characteristics of an omnidirectional microphone; the characteristics decay in inverse proportion to distance. S1 represents the decay characteristics of a bidirectional microphone; the distance decay characteristics are outstanding. The characteristics of S3 fall between those of S1 and S2.

According to the second configuration example of the signal processor 10 discussed above, the first electrical signal S1 having a bidirectional directionality pattern, and the second electrical signal S2 having an omnidirectional directionality pattern, are mixed in a predetermined ratio, whereby a balance can be brought out between the good SNR of the omnidirectional microphone and the effect of minimizing background noise afforded by the bidirectional microphone. Specifically, while maintaining the necessary sensitivity and SNR at an intermediate distance of 30 to 50 cm, there can be generated a directionality pattern of increased sensitivity in the direction of the hypothetical speaker, and there can be realized a practical microphone having outstanding distance decay characteristics and the ability to minimize background noise.

Moreover, because the second configuration example of the signal processor 10 discussed above has the effect of ameliorating the collapse in sensitivity (termed a "null point") in the bidirectional directionality pattern, the microphone can also be used for the object of preventing a sharp decline in sensitivity.

Mounting Method

Figure 18:
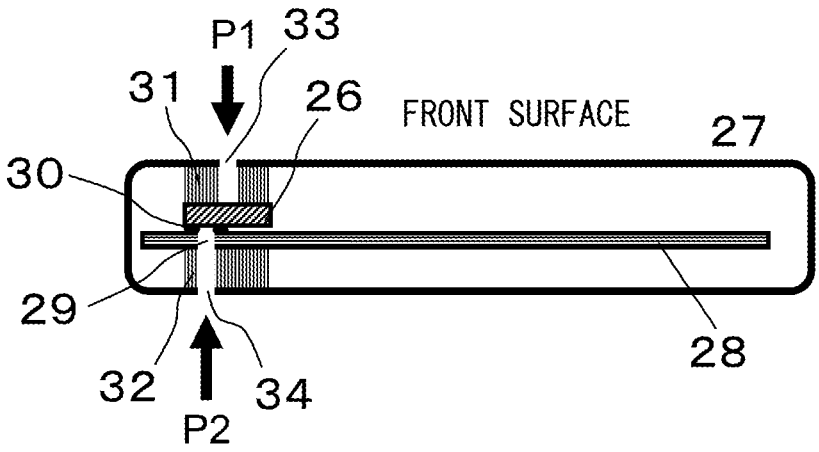
FIG. 18 is a sectional view of the microphone unit according to the first embodiment, shown mounted on the product chassis.
Figure 19:
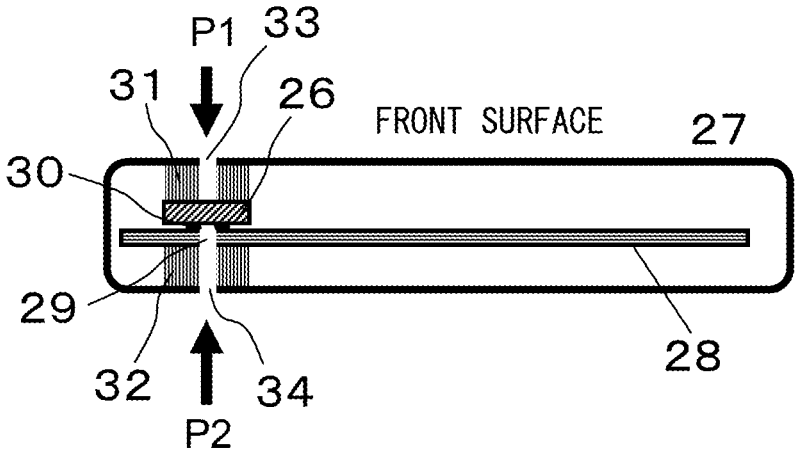
FIG. 19 is a sectional view of the microphone unit according to the first embodiment, shown mounted on the product chassis.
Figure 20:
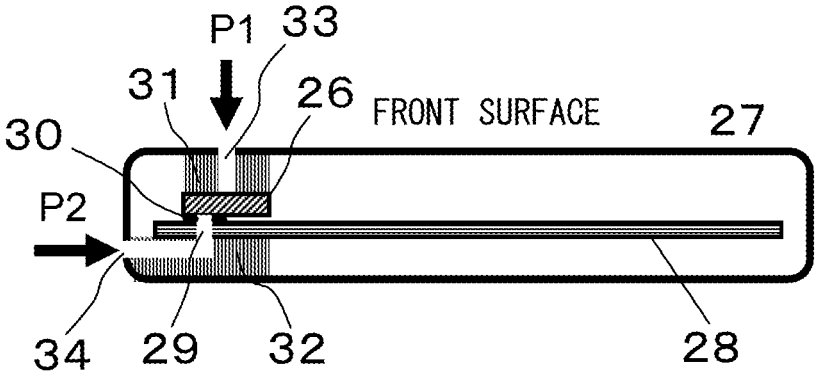
FIG. 20 is a sectional view of the microphone unit according to the first embodiment, shown mounted on the product chassis.

FIG. 18, FIG. 19, and FIG. 20 are diagrams showing a mounting method employed when installing the microphone unit 26 according to the present embodiment in a product housing 27 of a mobile terminal or a mobile device known as a smartphone. The product housing 27 accommodates a mounting substrate 28 for installation of a semiconductor chip for wireless telephone communications, as well as resistors, capacitors, and other passive components. The microphone unit 26 is installed on this mounting substrate 28.

The mounting substrate 28 is furnished with a substrate opening 29 that passes through the mounting substrate 28 from the front surface to the back surface. Installation takes place such that a sound hole (for example, the second opening 7 in FIG. 1B) which is furnished in the bottom surface of the substrate onto which the diaphragm of the microphone unit 26 will be installed (for example, the substrate 2 in FIG. 1A and FIG. 1B) is situated in opposition to the substrate opening 29. Additionally, the microphone unit 26 has electrode pads (not shown) on the bottom surface of the substrate part where the diaphragm is to be installed (for example, the substrate part 2 in FIG. 1A and FIG. 1B), and is joined by soldering to a wiring pattern (not shown) on the substrate top surface of the mounting substrate 27 which has been disposed in opposition to the electrode pads. Joining by soldering may be performed by a step of printing a cream solder onto the wiring pattern, disposing the microphone unit 26 at the predetermined position, and reflowing the solder, or the like.

Here, with regard to the aforedescribed joining by soldering, through joining by soldering in a manner that includes the perimeter of the substrate opening 29, joining can take place in an airtight manner such that there is no acoustic air leakage, affording the function of a seal ring 30.

In FIG. 18 and FIG. 19, the product housing 27 has a first housing sound hole 33 on the front surface, and a second housing sound hole 34 on the back surface. A sound hole on the top surface of the microphone unit 26 (for example, the third opening 9 in FIG. 1B) is coupled air-tightly via a first gasket 31 to the first housing sound hole 33, in such a manner that there is no air leakage between them; and a sound hole on the bottom surface of the microphone unit 26 (for example, the second opening 7 in FIG. 1B) is coupled air-tightly via a second gasket 32 to the second housing sound hole 34, in such a manner that there is no air leakage between them.

In FIG. 20, the product housing 27 has the first housing sound hole 33 on the front surface, and the second housing sound hole 34 on the back surface. A sound hole on the top surface of the microphone unit 26 (for example, the third opening 9 in FIG. 1B) and the first housing sound hole 33 are coupled air-tightly via a first gasket 31, in such a manner that there is no air leakage between them; and a sound hole on the bottom surface of the microphone unit 26 (for example, the second opening 7 in FIG. 1B) and the second housing sound hole 34 are coupled air-tightly via a second gasket 32, in such a manner that there is no air leakage between them.

In a case in which there is an unwanted gap between the sound holes of the microphone unit 26 and the housing sound holes of the product chassis 27, outside sound pressure can enter through the gap and affect the directional characteristics of the microphone, whereby the desired directionality pattern can no longer be obtained. Consequently, in preferred practice, the sound holes of the microphone unit 26 and the sound holes of the product chassis 27 are coupled via gaskets of material such as a urethane material, a rubber material, or other material that has elasticity, and that is impermeable or largely impermeable to air, so as to avoid air leakage therebetween.

Summary of First Embodiment

According to the present embodiment as discussed above, a thin-profile, unidirectional (including directionality approximating unidirectionality) microphone unit can be realized, and therefore a thin-profile microphone unit that minimizes null points in directionality, and that has both background noise minimizing functionality and SNR capability, can be realized.

Second Embodiment

Figure 21:
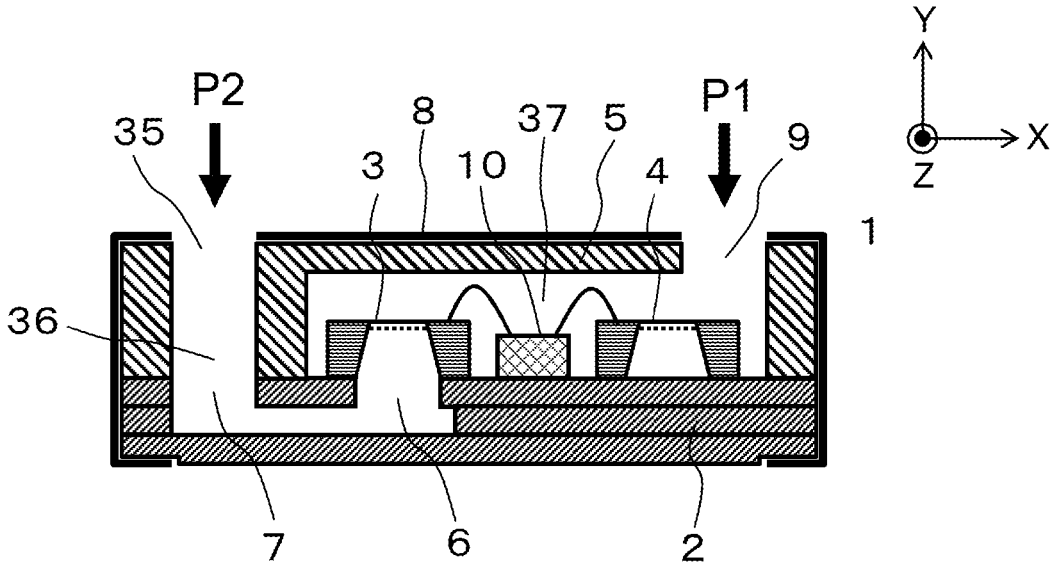
FIG. 21 is a sectional view of a microphone unit according to a second embodiment.

A microphone unit 1 according to a second embodiment is described by FIG. 21. With the microphone of the configuration shown in FIG. 21, through implementation of the signal processing described in the first configuration example and the second configuration example of the signal processor 10 discussed previously, the effect of reducing null points of a bidirectional directional microphone can be obtained.

The microphone unit 1 according to the second embodiment includes a substrate 2, a first diaphragm 3 for converting an input sound pressure to an electrical signal, and a second diaphragm 4 for converting an input sound pressure to an electrical signal. A first opening 6 and a second opening 7 are formed in the substrate top surface of the substrate 2, and the first opening 6 and the second opening 7 communicate through a sound path in the substrate interior. The substrate 2 is hollow in an internal layer thereof, with the first opening 6 and the second opening 7 connecting via a space extending in a direction parallel to the substrate surfaces.

The first diaphragm 3 is installed disposed on the top surface of the substrate 2 in such a way as to seal off and obscure the first opening 6. The second diaphragm 4 is installed disposed on the top surface of the substrate 2 in such a way as to seal off a partial region away from the first opening 6 on the top surface of the substrate 2.

During installation of the first diaphragm 3 and the second diaphragm 4 on the substrate 2, it is necessary for the substrate 2 and support parts supporting the first diaphragm 3 and the second diaphragm 4 to be bonded air-tightly, in such a way that no air leaks that could affect the acoustic characteristics occur. In preferred practice, an adhesive having stress absorbing effect will be used, so that the first diaphragm 3 and the second diaphragm 4 are not subjected to mechanical stresses from the substrate 2, causing the tensile force of the diaphragms to fluctuate. Epoxy adhesives, silicone adhesives, or the like could be employed as such an adhesive.

The microphone unit 1 in the present embodiment includes a signal processor 10 for performing arithmetic operations on the output signal of the first diaphragm 3 and the output signal of the second diaphragm 4, inside the internal space. Electrical connections among the first diaphragm 3, the second diaphragm 4, and the signal processor 10 are made, for example, by furnishing electrode terminals on the top surfaces of the first diaphragm 3, the second diaphragm 4, and the signal processor 10, and connecting the electrode terminals to one another by wire bonding.

Alternatively, it is possible to furnish electrode terminals on the bottom surfaces of the first diaphragm 3, the second diaphragm 4, and the signal processor 10; and to connect a flip chip to a wiring pattern which has been formed, in opposition to the electrode terminals, on the top surface of the substrate 2, and make electrical connections therebetween.

The microphone unit 1 in the present embodiment includes a cover 5 installed on the substrate 2. The cover 5 covers the first diaphragm 3 and the second diaphragm 4, and is joined to the outside edge of the substrate 2, forming an internal space 37. A third opening 9 is formed in the cover 5, and the internal space 37 communicates with the outside space via the third opening 9. Additionally, the cover 5 has a through-hole that connects from a fourth opening 35 furnished in the top surface to a fifth opening 36 furnished in the bottom surface; and is installed in such a manner that the fifth opening 36 of the cover 5 and the second opening 7 of the substrate 2 are in opposition.

In this way, sound pressure P1 inputted from the third opening 9 is transmitted, via the internal space 37, to the top surface of the first diaphragm 3; and sound pressure P2 inputted from the fourth opening 35 is transmitted, via the fifth opening 36, the second opening 7, and the first opening 6, to the bottom surface of the first diaphragm 3.

Here, because the sound pressure P1 impinges on the top surface of the first diaphragm 3, and the sound pressure P2 impinges on the bottom surface of the first diaphragm 3, an electrical signal reflecting a differential pressure (P1−P2) is outputted by the first diaphragm 3. Specifically, the first diaphragm 3 functions as a bidirectional microphone having a figure "8" directionality pattern.

Moreover, because the sound pressure P1 impinges on the top surface of the second diaphragm 4, and a constant baseline pressure impinges on the bottom surface of the second diaphragm 4 by virtue of being a closed space, a signal that reflects P1 is outputted by the second diaphragm 4. Specifically, the second diaphragm 4 functions as an omnidirectional microphone having a circular directionality pattern.

Figure 22:
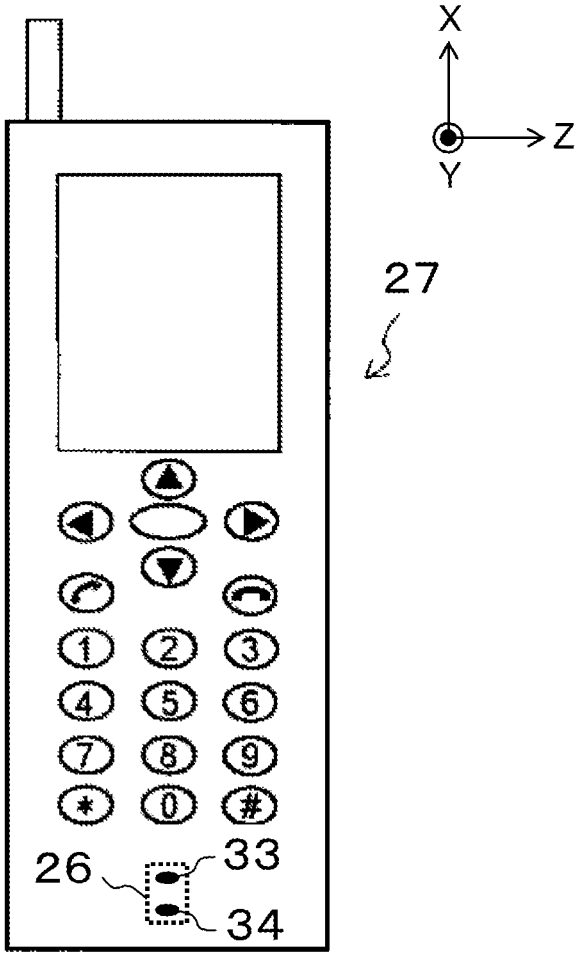
FIG. 22 is a front view of the microphone unit according to the second embodiment, shown installed in a mobile device.
Figure 23:
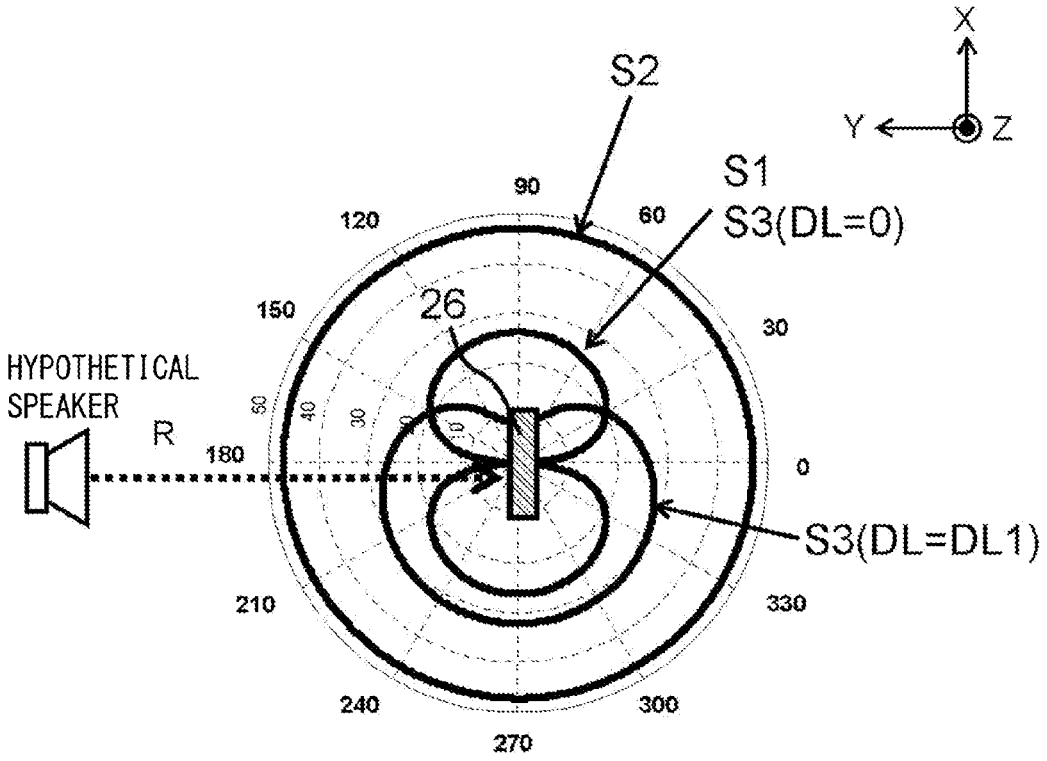
FIG. 23 is a diagram showing a directional characteristic pattern of the microphone unit according to the second embodiment.
Figure 24:
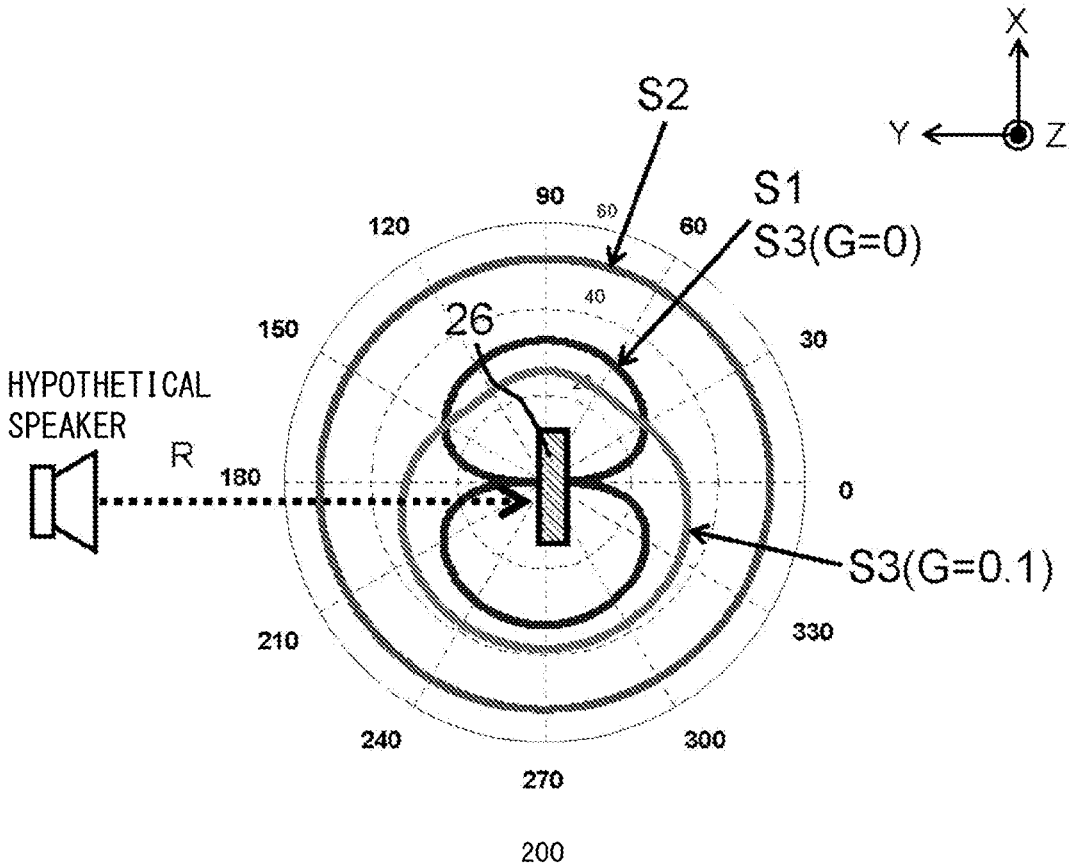
FIG. 24 is a diagram showing a directional characteristic pattern of the microphone unit according to the second embodiment.

In a case in which the microphone unit 26 according to the present embodiment is installed in the manner shown in FIG. 22 in a mobile terminal or a mobile device such as a smartphone, that is, with the two housing sound holes 33, 34 (for example, the third opening 9 and the fourth opening 35 in FIG. 21) lined up vertically on the front surface side of the product housing 27, when the signal processor 10 of the "first configuration of the signal processor" discussed previously is implemented, the directionality pattern will be like that shown in FIG. 23; and when the signal processor 10 of the "second configuration example of the signal processor" discussed previously is implemented, the directionality pattern will be like that shown in FIG. 24. In FIG. 23 and FIG. 24, S1 represents the directionality pattern of the first electrical signal S1 outputted by the first diaphragm 3, and has a bidirectional directionality pattern. S2 represents the directionality pattern of the second electrical signal S2 outputted by the second diaphragm 4, and has an omnidirectional directionality pattern.

When a mobile terminal, or a mobile device such as a smartphone or the like, is used in speech recognition or video phone mode, the hypothetical speaker may be located towards the front surface of the mobile device. In a case in which the null point orientation of the directionality pattern is located towards the front surface as with S1, a resultant problem is that when the hypothetical speaker enters the null point orientation, the speech level of the speaker drops.

In a case in which the signal processor 10 uses the signal processing of the "first configuration of signal processing," the directionality pattern of S3 can be controlled by changing the amount of delay DL and the gain G. When G=1 and DL=0, the bidirectional directionality pattern is like that shown by S3 (DL=0) of FIG. 23, and matches S1. Additionally, when G=1 and DL=DL1 (microphone unit sound hole spacing/speed of sound), the directionality pattern is like that shown by S3 (G=DL1) of FIG. 23. S3 of FIG. 23 shows the directionality pattern when the frequency is 1 kHz, and the microphone-to-sound source distance is 40 cm.

Specifically, by controlling directionality by prompting the signal processor 10 to perform the signal processing of the "first configuration of signal processing," it is possible to reduce the null point-induced collapse in sensitivity in the direction of the front face. Moreover, in the directionality pattern of S3 (G=DL1), a higher distance decay rate is obtained as compared with S2, and higher effect in minimizing background noise can be obtained.

In a case in which the signal processor 10 uses the signal processing of the "second configuration of signal processing," the directionality pattern of S3 can be controlled by changing the gain G. When G=0, the bidirectional directionality pattern is like that shown by S3 (G=0) of FIG. 24, and matches S1. Additionally, when G=0.1, the directionality pattern is like that shown by S3 (G=0.1) of FIG. 24. S3 of FIG. 24 shows the directionality pattern when the frequency is 1 kHz, and the microphone-to-sound source distance is 40 cm.

Specifically, by controlling directionality by prompting the signal processor 10 to perform the signal processing of the "second configuration example of signal processing," it is possible to reduce the null point-induced collapse in sensitivity in the direction of the front face. Moreover, in the directionality pattern of S3 (G=0.1), a higher distance decay rate is obtained as compared with S2, and higher effect in minimizing background noise can be obtained.

Summary of Second Embodiment

According to the present embodiment as discussed above, a thin-profile, unidirectional (including directionality approximating unidirectionality) microphone unit can be realized, and therefore a thin-profile microphone unit that minimizes null points in directionality, and that has both background noise minimizing functionality and SNR capability, can be realized.

Third Embodiment

Figure 25:
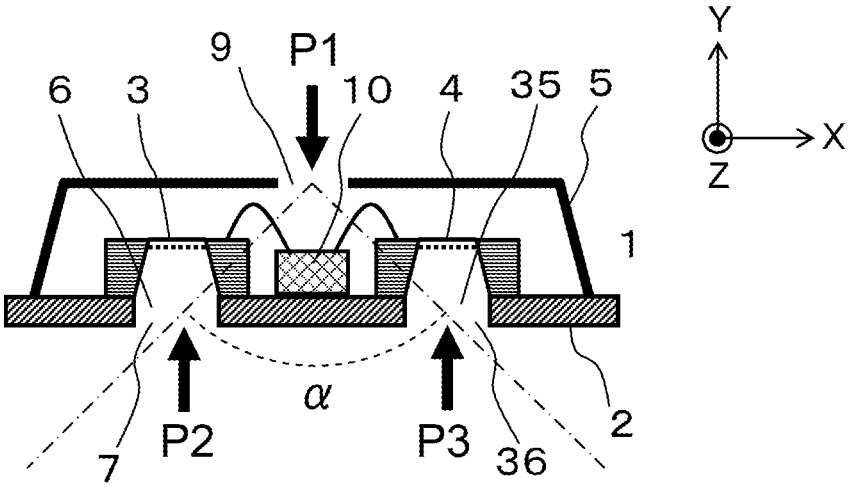
FIG. 25 is a sectional view of a microphone unit according to a third embodiment.

A microphone unit 1 according to a third embodiment is described by FIG. 25. With the microphone of the configuration shown in FIG. 25, through implementation of the signal processing described in the "second configuration example of the signal processor" discussed previously, the orientation at which the sensitivity of the bidirectional directional microphone is highest (the beam orientation) can be rotated freely within a range of 0 to 360°.

The microphone unit 1 according to the present embodiment includes a substrate 2, a first diaphragm 3 for converting an input sound pressure to an electrical signal, and a second diaphragm 4 for converting an input sound pressure to an electrical signal. A first opening 6 and a fourth opening 35 are formed in the substrate top surface at the substrate top surface of the substrate 2; and a second opening 7 and a fifth opening 36 are formed in the substrate bottom surface. The first opening 6 communicates with the second opening 7 through a sound path in the substrate interior; and the fourth opening 35 communicates with the fifth opening 36 through a sound path in the substrate interior.

The first diaphragm 3 is installed disposed on the top surface of the substrate 2 in such a way as to seal off and obscure the first opening 6. The second diaphragm 4 is installed disposed on the top surface of the substrate 2 in such a way as to seal off and obscure the fourth opening 35.

During installation of the first diaphragm 3 and the second diaphragm 4 on the substrate 2, it is necessary for the substrate 2 and support parts supporting the first diaphragm 3 and the second diaphragm 4 to be bonded air-tightly, in such a way that no air leaks that could affect the acoustic characteristics occur. In preferred practice, an adhesive having a stress absorbing effect will be used, so that the first diaphragm 3 and the second diaphragm 4 are not subjected to mechanical stresses from the substrate 2, causing the tensile force of the diaphragms to fluctuate. Epoxy adhesives, silicone adhesives, or the like could be employed as such an adhesive.

The microphone unit 1 in the present embodiment includes a cover 5 for covering the first diaphragm 3 and the second diaphragm 4, the cover 5 being joined in an air-tight manner to the outside edge of the substrate 2, forming an internal space. A third opening 9 is formed in the cover 5, and the internal space communicates with the outside space via the third opening 9.

Here, sound pressure P1 inputted from the third opening 9 impinges on the top surfaces of the first diaphragm 3 and the second diaphragm 4, sound pressure P2 inputted from the second opening 7 impinges on the bottom surface of the first diaphragm 3, and sound pressure P3 inputted from the fifth opening 36 impinges on the bottom surface of the second diaphragm 4; and therefore a signal reflecting a differential pressure (P1−P2) is outputted by the first diaphragm 3, and a signal reflecting a differential pressure (P1−P3) is outputted by the second diaphragm 4.

Figure 26:
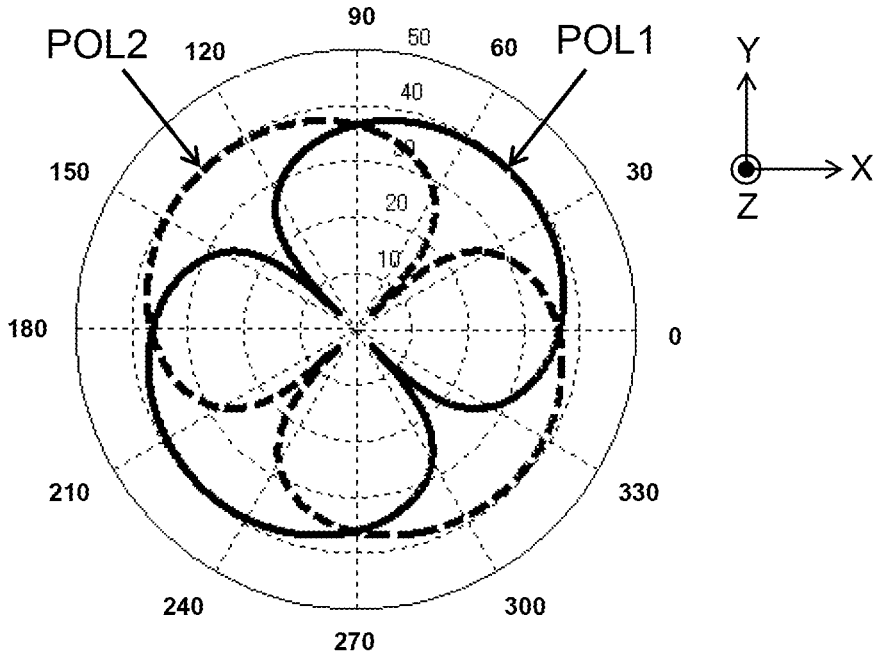
FIG. 26 is a diagram showing a directional characteristic pattern of the microphone unit according to the third embodiment.

Specifically, the first diaphragm 3 functions as a bidirectional microphone that has a figure "8" directionality pattern as shown by POL1 (the solid line) in FIG. 26, and the second diaphragm 4 functions as a bidirectional microphone that has a figure "8" directionality pattern as shown by POL2 (the dotted line) in FIG. 26.

The microphone unit 1 in the present embodiment includes a signal processor 10 for performing arithmetic operations on the output signal of the first diaphragm 3 and the output signal of the second diaphragm 4, inside the internal space. Electrical connections among the first diaphragm 3, the second diaphragm 4, and the signal processor 10 are made, for example, by furnishing electrode terminals on the top surfaces of the first diaphragm 3, the second diaphragm 4, and the signal processor 10, and connecting the electrode terminals to one another by wire bonding.

Alternatively, it is possible to furnish electrode terminals on the bottom surfaces of the first diaphragm 3, the second diaphragm 4, and the signal processor 10; and to connect a flip chip to a wiring pattern which has been formed, in opposition to the electrode terminals, on the top surface of the substrate 2, to thereby make electrical connections therebetween.

Signals on which arithmetic operations have been performed by the signal processor 10 are transmitted from the signal processor 10 to the wiring pattern on the top surface of the substrate 2, and, via internal wiring of the substrate 2, reach an electrode part (not shown) on the bottom surface of the substrate 2. Routing of signals from the signal processor 10 to the wiring pattern on the top surface of the substrate 2 can be accomplished, for example, in the above manner, through connection by wire bonding or flip chip mounting in the aforedescribed manner.

As the substrate 2, it is preferable to use a printed circuit board substrate on which it is possible to form wiring patterns on the substrate front surface. For example, a substrate such as a glass epoxy substrate, a ceramic substrate, a polyimide film substrate, or the like can be used.

In order to prevent the microphone unit 1 from being affected by noise due to external electromagnetic waves, it is preferable for the cover 5 to be constituted of a conductive metal material, and to be connected to a fixed potential, such as the ground of the substrate 2.

Alternatively, in the same way as in the case of FIG. 2B, the substrate 2 may be covered with a cover 5 comprising a structure of a non-conductive material, and a shield cover 8 made of metal then installed so as to cover the cover 5. In a case in which the cover 5 is covered by the metal shield cover 8, in order to connect the shield cover 8 to a fixed potential, the end of the shield cover 8 may be crimped at the bottom surface of the substrate 2, with this crimped portion functioning as an electrode. When the microphone unit 1 is mounted onto a mounting substrate, the effect of an electromagnetic shield can be enhanced by soldering the crimped portion, to join it to the ground of the mounting substrate.

Figure 27:
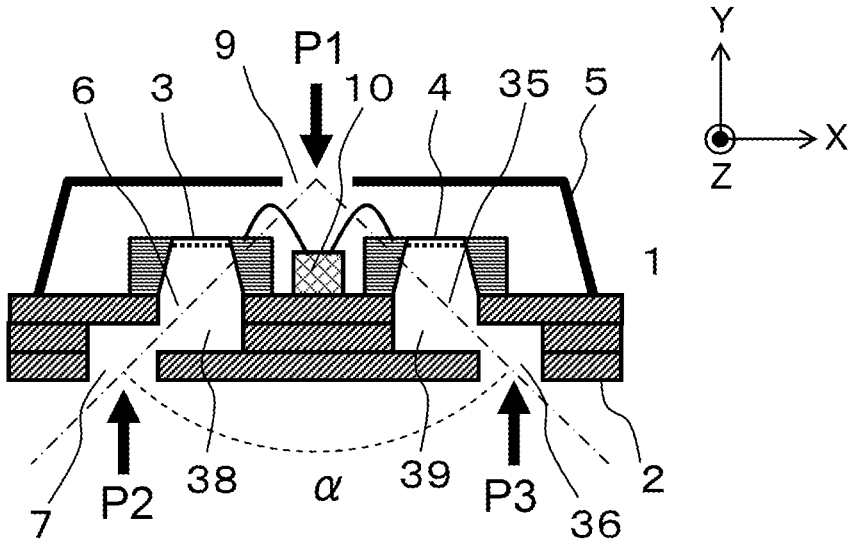
FIG. 27 is a sectional view of the microphone unit according to the third embodiment.

Like the second modification example in the first embodiment discussed previously, the microphone unit according to the present embodiment may be constituted as shown in FIG. 27, in such a way that the first opening 6 formed in the top surface of the substrate 2 and the second opening 7 formed in the bottom surface, as well as the fourth opening 35 formed in the top surface of the substrate 2 and the fifth opening 36 formed in the bottom surface, are disposed at an offset; and communication from the first opening 6 to the second opening 7, as well as from the fourth opening 35 to the fifth opening 36, takes place via a first hollow sound path 38 and a second hollow sound path 39 that include a hollow layer extending in a direction parallel to the substrate surfaces, in an internal layer of the substrate 2.

Third Configuration Example of Signal Processor

Figure 28:
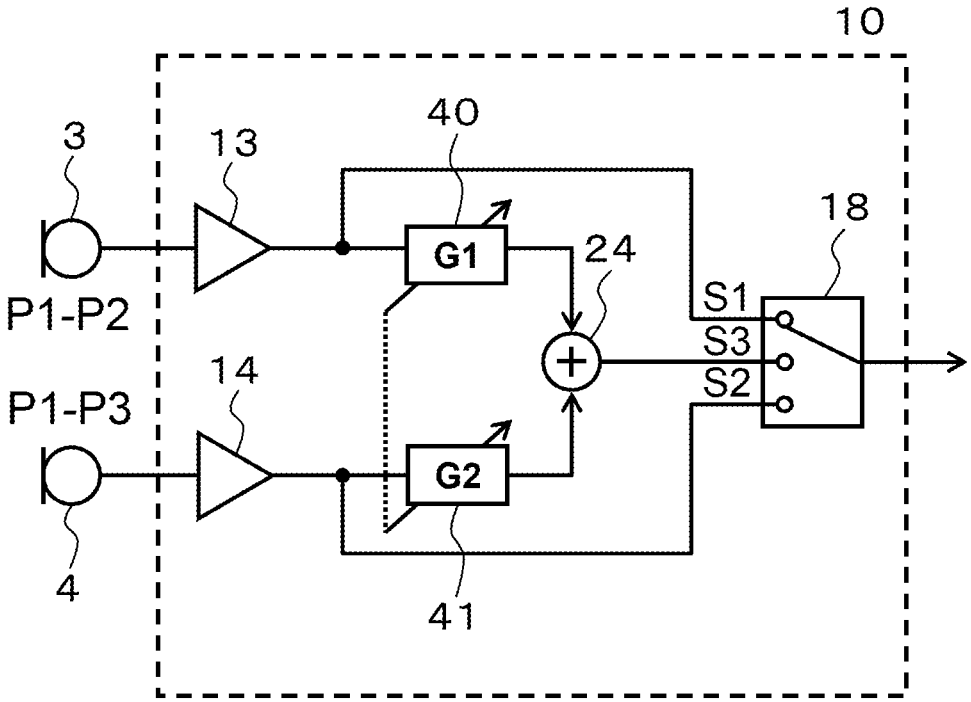
FIG. 28 is a diagram showing an arithmetic processing according to a third configuration example of a signal processor.

FIG. 28 is a diagram showing a third configuration example of the signal processor 10, and includes the connection relationships with the first diaphragm 3 and the second diaphragm 4.

The signal processor 10 has a first gain part 40 for imparting a predetermined gain G1 to the first electrical signal S1 outputted by the first diaphragm 3, and outputting the signal; a second gain part 41 for imparting a predetermined gain G2 to the second electrical signal S2 outputted by the second diaphragm 4, and outputting the signal; and an adder 24 for adding the first electrical signal S1 and the second electrical signal S2.

Here, an arrangement whereby, as shown in FIG. 28, once the first electrical signal S1 outputted by the first diaphragm 3 is amplified by the first amplifier 13 and the second electrical signal S2 outputted by the second diaphragm 4 is amplified by the second amplifier 14, in the arithmetic processing, the amplified signal outputted by the first amplifier 13 is taken to be the first electrical signal S1, and the amplified signal outputted by the second amplifier 14 is taken to be the second electrical signal S2, is also acceptable. In a case in which the signals outputted by the first diaphragm 3 and the second diaphragm 4 have high output impedance, it will be preferable to perform current amplification before processing.

In the first gain part 40, a predetermined gain G1 is imparted to the electrical signal S1=(P1−P2) outputted by the first diaphragm 3 to generate a signal (G1·(P1−P2)); and in the second gain part 41, a predetermined gain G2 is imparted to the electrical signal S2=(P1−P3) outputted by the second diaphragm 4, to generate a signal (G2·(P1−P3)). In the adder 24, the signal (G1·(P1−P2)) and the signal (G2·(P1−P3)) are added together, and an addition signal S3=(G1·(P1−P2)+G2·(P1−P3)) is outputted.

Figure 29:
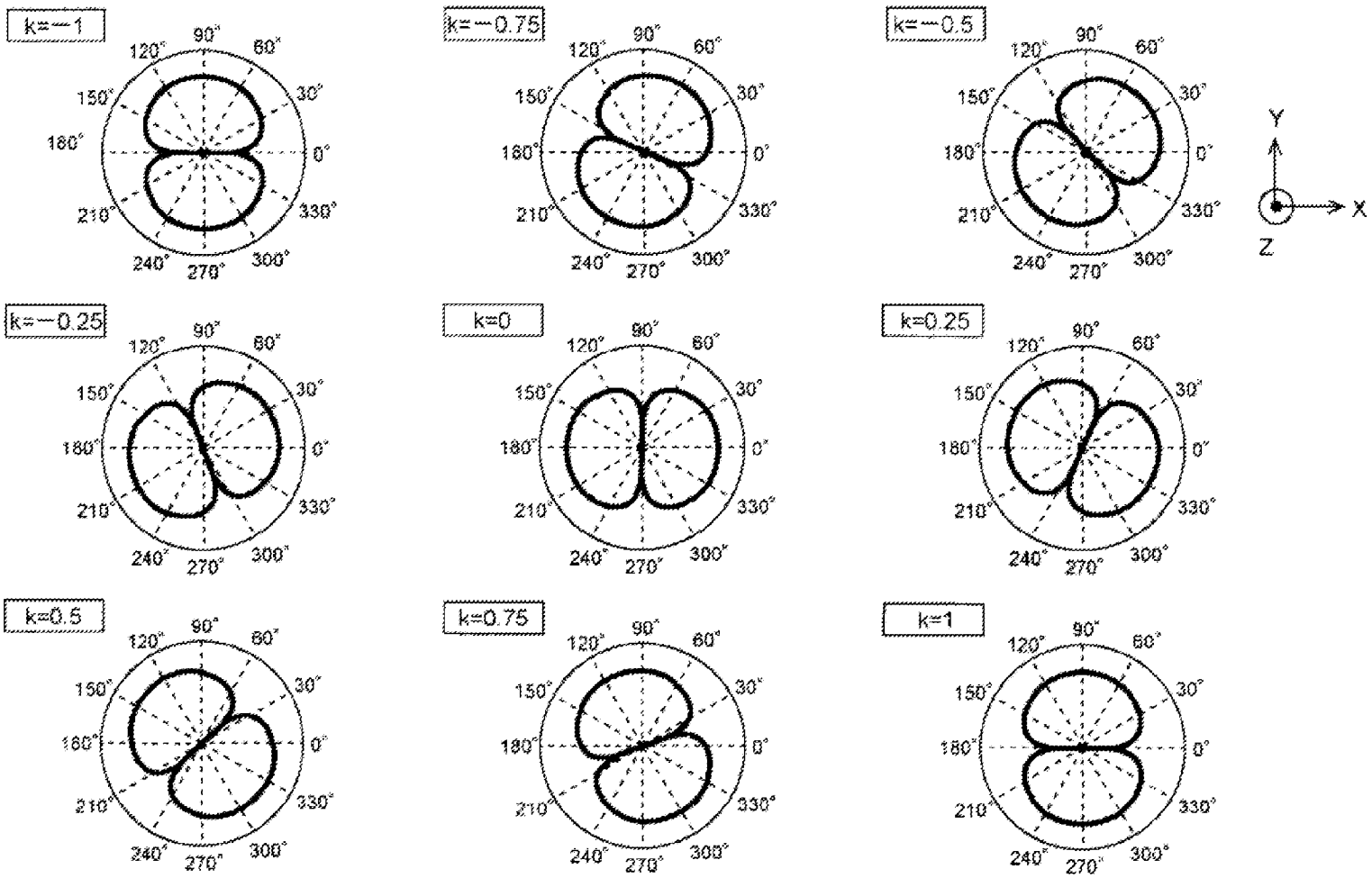
FIG. 29 is a diagram for describing control of the directional characteristic pattern of the microphone unit according to the third embodiment.

FIG. 29 shows changes in directionality pattern observed in a case in which $G1=k/(k^2+1)^{1/2}$ and $G2=1/(k^2+1)^{1/2}$, when k ($-1 \le k \le 1$) changes. In association with a change in k, the orientation of high sensitivity of directionality can be controlled freely within a range of 0 to 360°.

The microphone unit 1 according to the present embodiment has a fundamentally bidirectional directionality pattern, and has null points. In a case of mounting within the product housing 27 as shown in FIG. 22, the orientation at which the bidirectional directionality pattern exhibits maximum sensitivity can be set so as to coincide with the orientation of the hypothetical speaker, and control can take place in a manner that reduces the drop in sensitivity due to the effects of the null points.

Mounting Method

Figure 30:
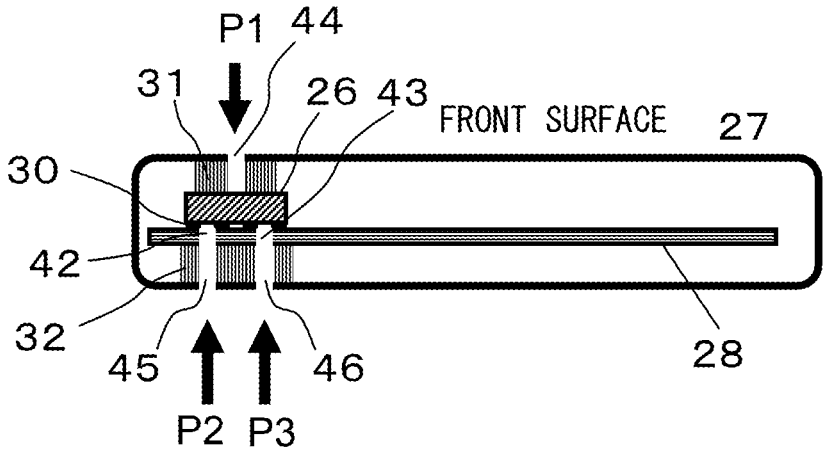
FIG. 30 is a sectional view of the microphone unit according to the third embodiment, shown in a mobile device.

FIG. 30 is a diagram showing a mounting method employed when installing the microphone unit 26 according to the present embodiment in a product housing 27 of a mobile terminal, or a mobile device known as a smartphone. The product housing 27 accommodates a mounting substrate 28 for installation of a semiconductor chip for wireless telephone communications, as well as resistors, capacitors, and other passive components. The microphone unit 26 is installed on this mounting substrate 28.

The mounting substrate 28 is furnished with substrate openings 42, 43. Installation takes place such that the second opening 7 and the fifth opening 36 which are furnished to the bottom surface of the substrate 2 where the diaphragm of the microphone unit 26 is to be installed are situated in opposition to the first and second substrate openings 42, 43 which pass through the mounting substrate 28 from the front surface to the back surface thereof.

Additionally, the microphone unit 26 has electrode pads (not shown) on the bottom surface of the substrate 2 onto which the diaphragm will be installed, and is joined by soldering to a wiring pattern (not shown) on the substrate top surface of the mounting substrate 28 which has been disposed in opposition to the electrode pads. Joining by soldering may be performed by a step of printing a cream solder onto the wiring pattern, disposing the microphone unit 26 at the predetermined position, and reflowing the solder, or the like.

Here, with regard to the aforedescribed joining by soldering, through joining by soldering in a manner that includes the peripheries of the first and second substrate openings 42, 43, joining can take place in an airtight manner such that there is no acoustic air leakage, affording the function of a seal ring 30.

The product housing 27 has a first housing sound hole 44 on the front surface, and a second housing sound hole 45 and a third housing sound hole 46 on the back surface. The third opening 9 of the top surface of the microphone unit 26 is coupled air-tightly via a first gasket 31 to the first housing sound hole 44, in such a manner that there is no air leakage between them; and the second opening 7 and the fifth opening 36 of the lower surface of the microphone unit 26 are coupled air-tightly via a second gasket 32 to the second housing sound hole 45 and the third housing sound hole 46, in such a manner that there is no air leakage between them.

In a case in which there is an unwanted gap between the sound holes of the microphone unit 26 and the housing sound holes of the product chassis 27, outside sound pressure can enter through the gap and affect the directional characteristics of the microphone, whereby the desired directionality pattern can no longer be obtained. Consequently, in preferred practice, the sound holes of the microphone unit 26 and the sound holes of the product chassis 27 are coupled via gaskets of material such as a urethane material, a rubber material, or other material that has elasticity, and that is impermeable to air, so as to avoid air leakage therebetween.

Summary of Third Embodiment

According to the present embodiment as discussed above, by implementing signal processing, the orientation at which the sensitivity of a bidirectional directional microphone is highest (the beam orientation) can be rotated freely within a range of 0 to 360°.

Figure 31:
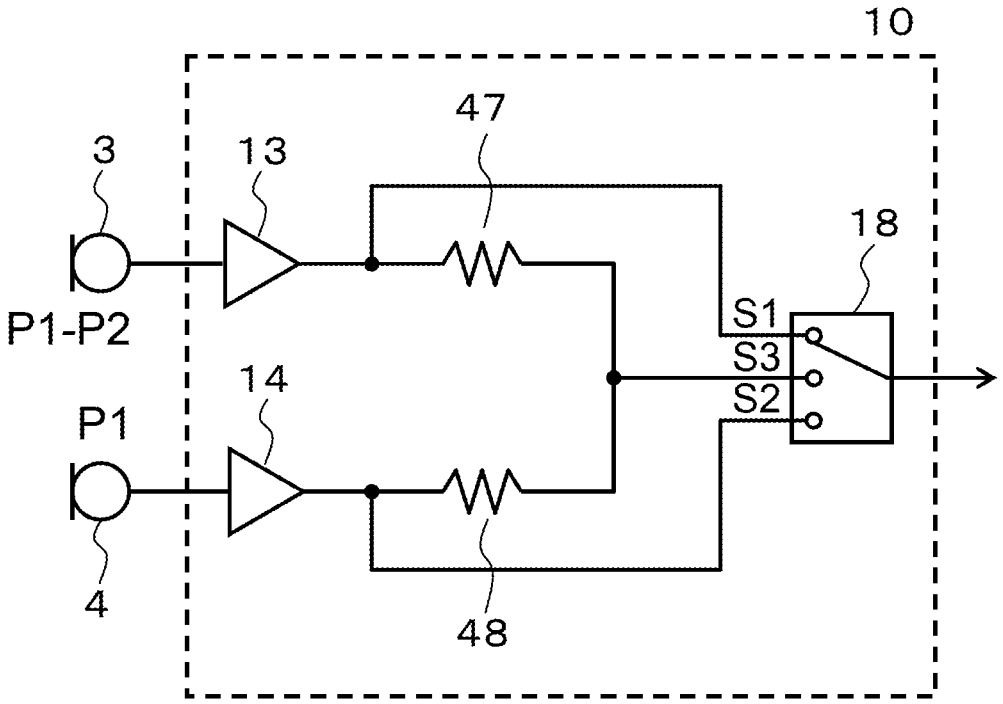
FIG. 31 is a diagram showing an arithmetic processing according to the second configuration example and the third configuration example of the signal processor.

Moreover, in the "second configuration example of the signal processor" and the "third configuration example of the signal processor," the method for performing an addition operation in which the first electrical signal outputted by the first diaphragm 3 and the second electrical signal outputted by the second diaphragm 4 described in FIG. 15A and FIG. 28 are respectively weighted by a predetermined ratio may be one involving resistor addition of the first electrical signal and the second electrical signal, as shown in FIG. 31. With this method, addition of the two signals can be realized through an exceedingly simple configuration.

Additional

Figure 32:
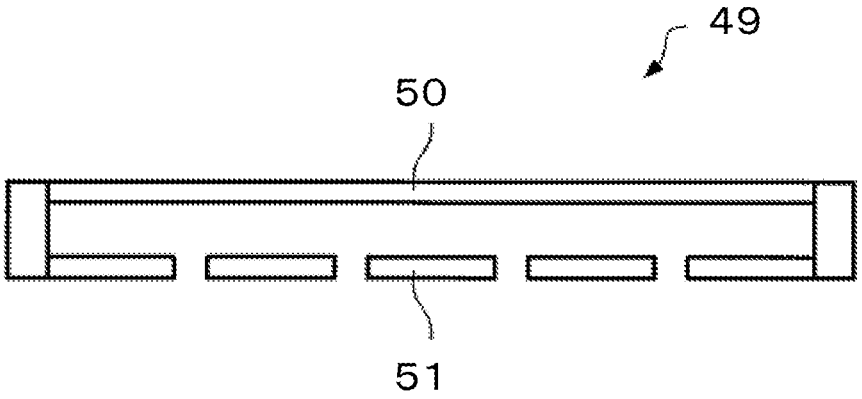
FIG. 32 is a sectional view of a condenser microphone.
Figure 33:
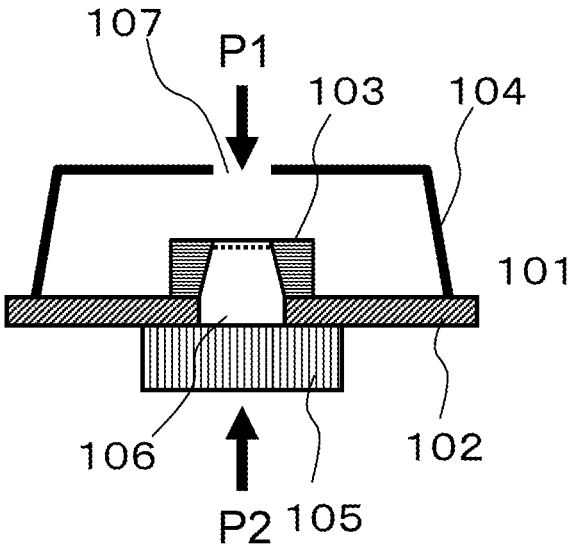
Related Art FIG.33
FIG. 33 is a sectional view of a microphone according to the related art.
Figure 34:
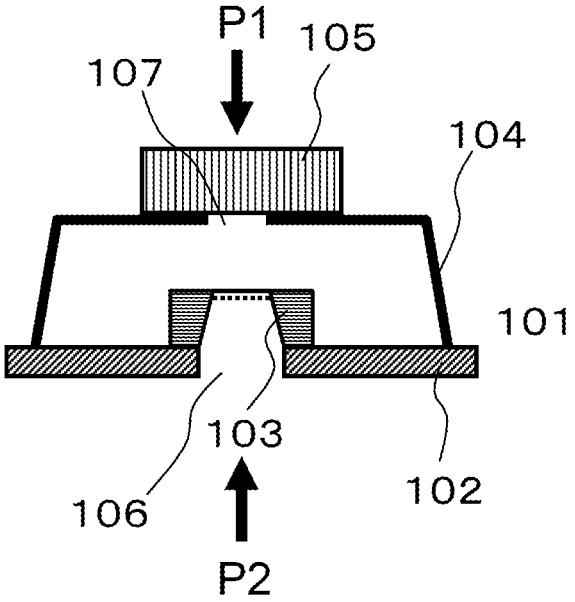
Related Art FIG.34
FIG. 34 is a sectional view of a microphone according to the related art.

The configuration of a condenser microphone 49 is described below, as an example of a microphone installable in the microphone unit according to the present invention. FIG. 32 is a sectional view schematically showing the condenser microphone 49.

The condenser microphone 49 has a diaphragm 50. The diaphragm 50 is the equivalent of the first diaphragm 3 and the second diaphragm 4 in the microphone unit 1 or 26 according to the preceding embodiments. The diaphragm 50 is a film (thin film) that receives sound and vibrates; it has electrical conductivity, and forms one electrode terminal. The condenser microphone 49 also has an electrode 51. The electrode 51 and the diaphragm 50 are disposed in opposition, in proximity to one another. In so doing, the electrode 51 and the diaphragm 50 form capacitance. When a sound wave strikes the condenser microphone 49, the diaphragm 50 vibrates, causing the gap between the diaphragm 50 and the electrode 51 to change, and the electrostatic capacitance between the diaphragm 50 and the electrode 51 to change. By extracting this change in electrostatic capacitance in the form of a change in voltage, for example, there can be acquired an electrical signal based on vibration of the diaphragm 50. Specifically, sound waves striking the condenser microphone 49 can be converted to an electrical signal. The condenser microphone 49 may have a configuration in which the electrode 51 is unaffected by sound waves. For example, the electrode 51 may have a mesh structure.

However, microphones (diaphragm 50) installable in the microphone unit according to the present invention are not limited to condenser microphones, and any of the microphones known in the art may be implemented. For example, the diaphragm 50 may serve as a diaphragm of any of various types of microphone, such as a dynamic type, a magnetic type, a crystal type, or the like.

Alternatively, the diaphragm 50 may be a semiconductor film (for example, a silicon film). Specifically, the diaphragm 50 may serve as a diaphragm of a silicon (Si) microphone. Smaller size and higher performance of the microphone unit 1 can be realized by utilizing a silicon microphone.

Whereas a mode whereby arithmetic processing is included within the signal processor 10 is described in the first to third configuration examples of the signal processor, there is no need for all signal processing to be performed inside the microphone unit 1. Configurations in which processing of some or all of the arithmetic processing takes place outside the microphone unit 1 are also acceptable.

In the aforedescribed embodiments, some or all of the processes of the signal processor 10 may be processed outside the microphone unit 1. Additionally, it is possible for some or all of the processes of the signal processor 10 to be processed through software processing. In this case, the microphone unit 1 and the external signal processor taken together would constitute a speech signal processing system.

For example, as shown in FIG. 6, a configuration for the microphone unit 1 whereby the first electrical signal outputted by the first diaphragm 3 and the second electrical signal outputted by the second diaphragm 4, after amplification by the first amplifier and the second amplifier, are outputted to outside the microphone unit 1, whereupon arithmetic processing takes place in a subsequent stage, is also acceptable. In yet another acceptable configuration, arithmetic processing takes place in a subsequent stage that follows a switching part 18 (see FIG. 7A, for example).

In the aforedescribed embodiments, the directionality pattern may be changed in such a way as to maximize the output amplitude or output power of the microphone unit installed in a mobile device.

In the aforedescribed embodiments, another acceptable configuration is one in which a mobile device is provided with an angle sensor, and the directionality pattern is changed in such a way as to maximize sensitivity to the speaker, in response to a detection value of the angle sensor.

In the aforedescribed embodiments, another acceptable configuration is one in which a mobile terminal is provided with an image sensor, characteristic portions of the human face are extracted from an image captured by the image sensor, and the beam orientation is faced towards the direction of the person's mouth.

Another acceptable configuration is one in which a mobile device is provided with a contact sensor, a determination is made as to whether the surface of the mobile device is in contact with the skin, and, when contact is determined to have been made, a bidirectional directionality pattern is assumed, and a function as a close talking microphone that captures near sounds while minimizing distant sounds is realized.

Additionally, whereas in the "second configuration example of the signal processor," the gain part 25 was furnished to the second diaphragm 4 side, the gain part 25 could instead be furnished to the first diaphragm 3 side, so that the gain part 25 would impart a predetermined gain G to the first electrical signal S1 outputted by the first diaphragm 3, and output the signal.

Additionally, a microphone unit provided with constituent elements common to both the microphone unit 1 according to the first embodiment and microphone unit 1 according to the second embodiment, specifically, "a microphone unit, characterized by being provided with a first vibrating part for converting a sound signal to an electrical signal on the basis of vibration of a first diaphragm; a second vibrating part for converting a sound signal to an electrical signal on the basis of vibration of a second diaphragm; and a housing for accommodating the first vibrating part and the second vibrating part, the housing being provided with a first sound hole, and a second sound hole; wherein the housing is provided with: a first sound path for transmitting sound pressure inputted from the first sound hole to one surface of the first diaphragm and to one surface of the second diaphragm; a second sound path for transmitting sound pressure inputted from the second sound hole to the other surface of the second diaphragm; and a closed space facing the other surface of the first diaphragm" may be employed in its entirety, in a manner analogous to the microphone unit 1 according to the first embodiment and the microphone unit 1 according to the second embodiment.

Additionally, a microphone unit provided with the principal constituent elements of the microphone unit 1 according to the third embodiment, specifically, "a microphone unit, characterized by being provided with a first vibrating part for converting a sound signal to an electrical signal on the basis of vibration of a first diaphragm; a second vibrating part for converting a sound signal to an electrical signal on the basis of vibration of a second diaphragm; an electrical circuit part for processing electrical signals obtained from the first vibrating part and the second vibrating part; and a housing for accommodating the first vibrating part, the second vibrating part, and the electrical circuit, the housing being provided with a first sound hole, a second sound hole, and a third sound hole; wherein the housing is provided with: a first sound path for transmitting sound pressure inputted from the first sound hole to one surface of the first diaphragm and to one surface of the second diaphragm; a second sound path for transmitting sound pressure inputted from the second sound hole to the other surface of the first diaphragm; and a third sound path for transmitting sound pressure inputted from the third sound hole to the other surface of the second diaphragm" may be employed in its entirety, in a manner analogous to the microphone unit 1 according to the third embodiment.

Figure 7B:
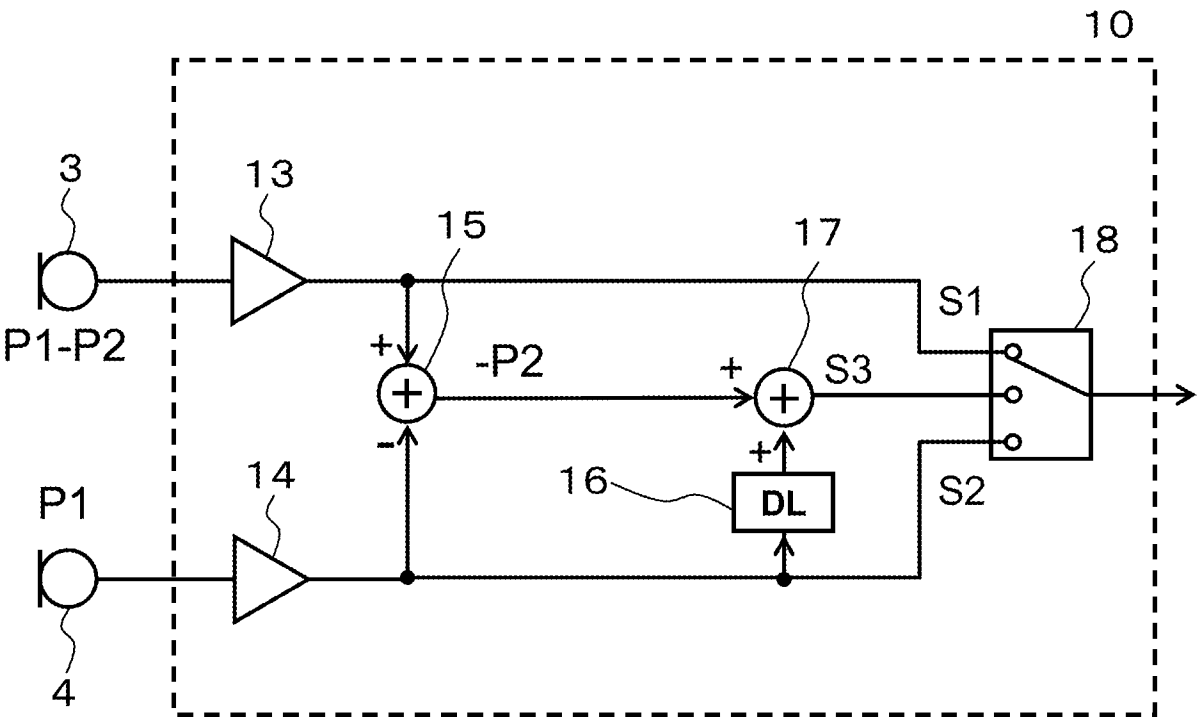
FIG. 7B is a diagram showing a modification example of an arithmetic processing according to the first configuration example of a signal processor.
Figure 10B:
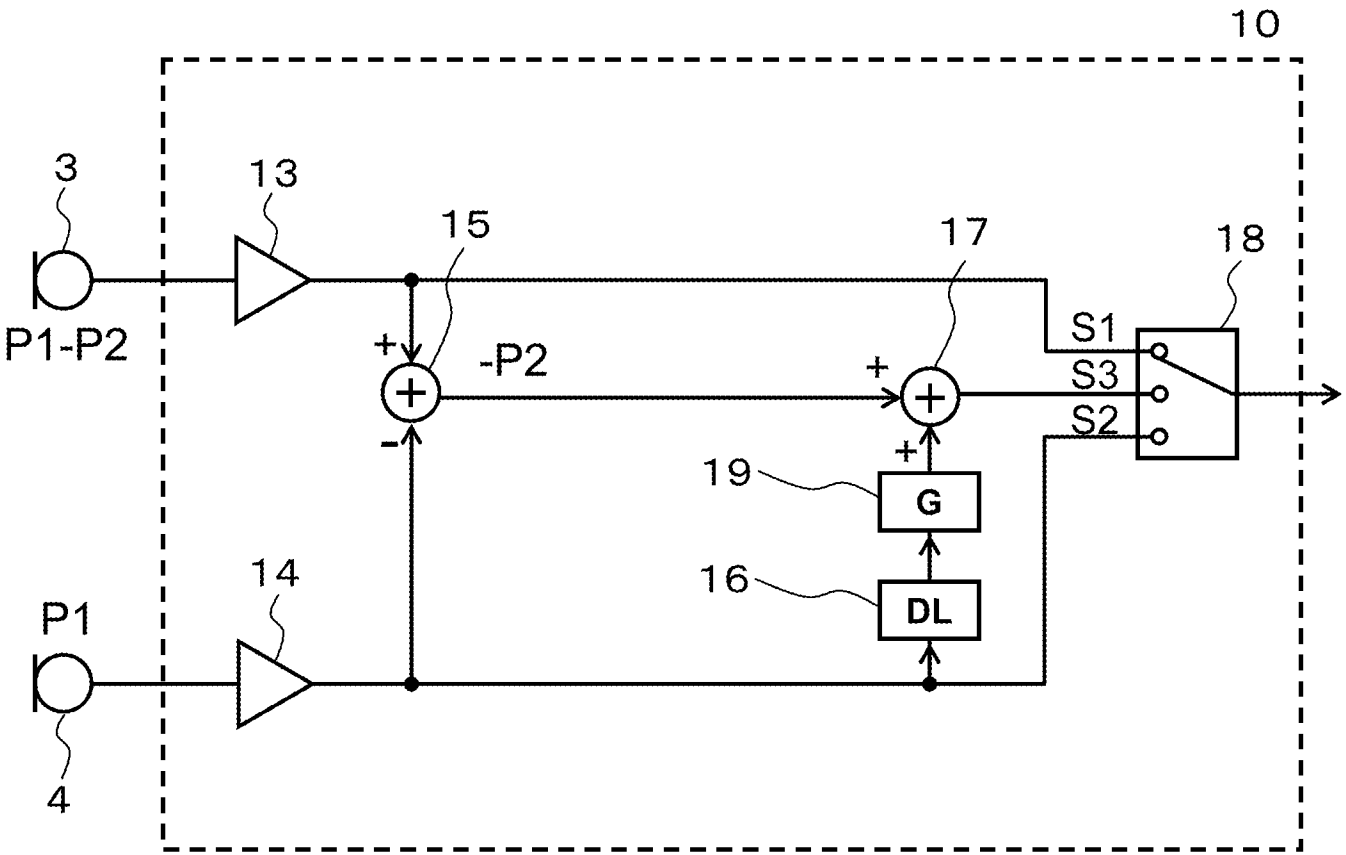
FIG. 10B is a diagram showing a modification example of an arithmetic processing of a signal processor that includes a gain part.
Figure 11B:
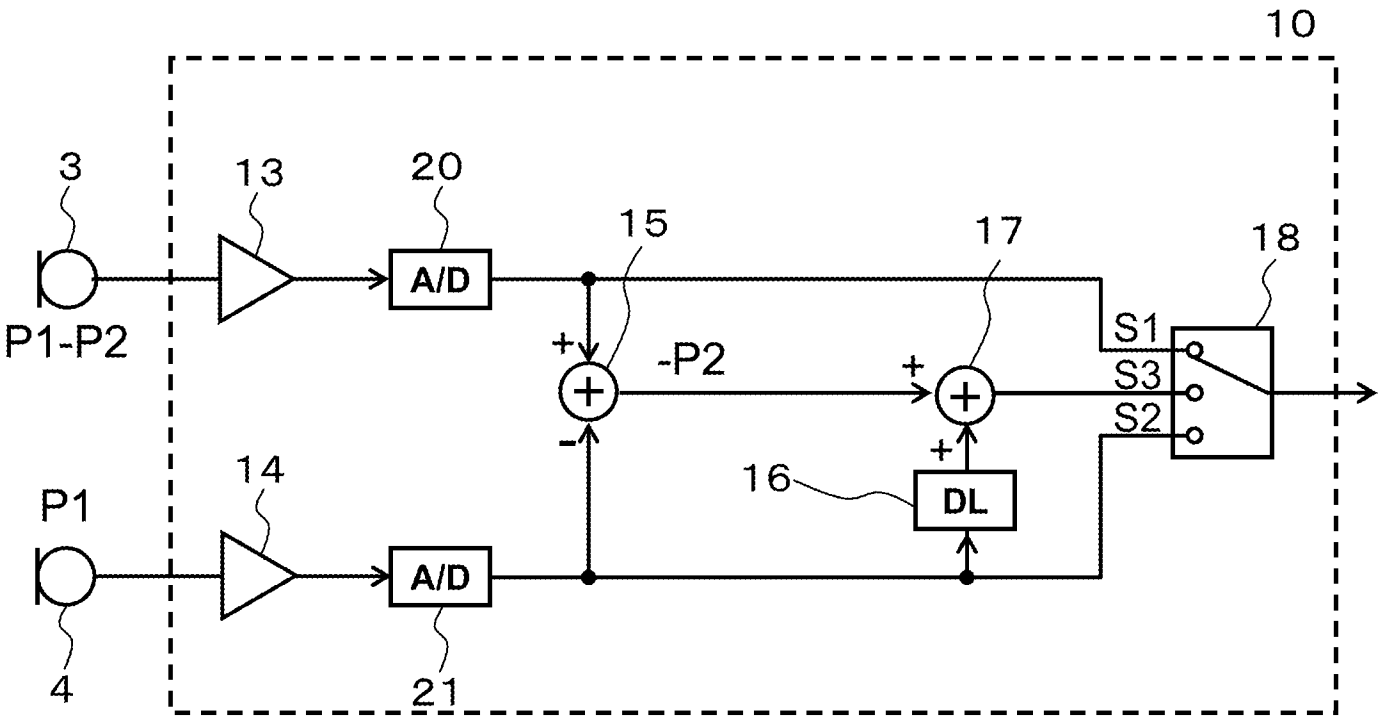
FIG. 11B is a diagram showing a modification example of an arithmetic processing of a signal processor that includes an AD converter.
Figure 14B:
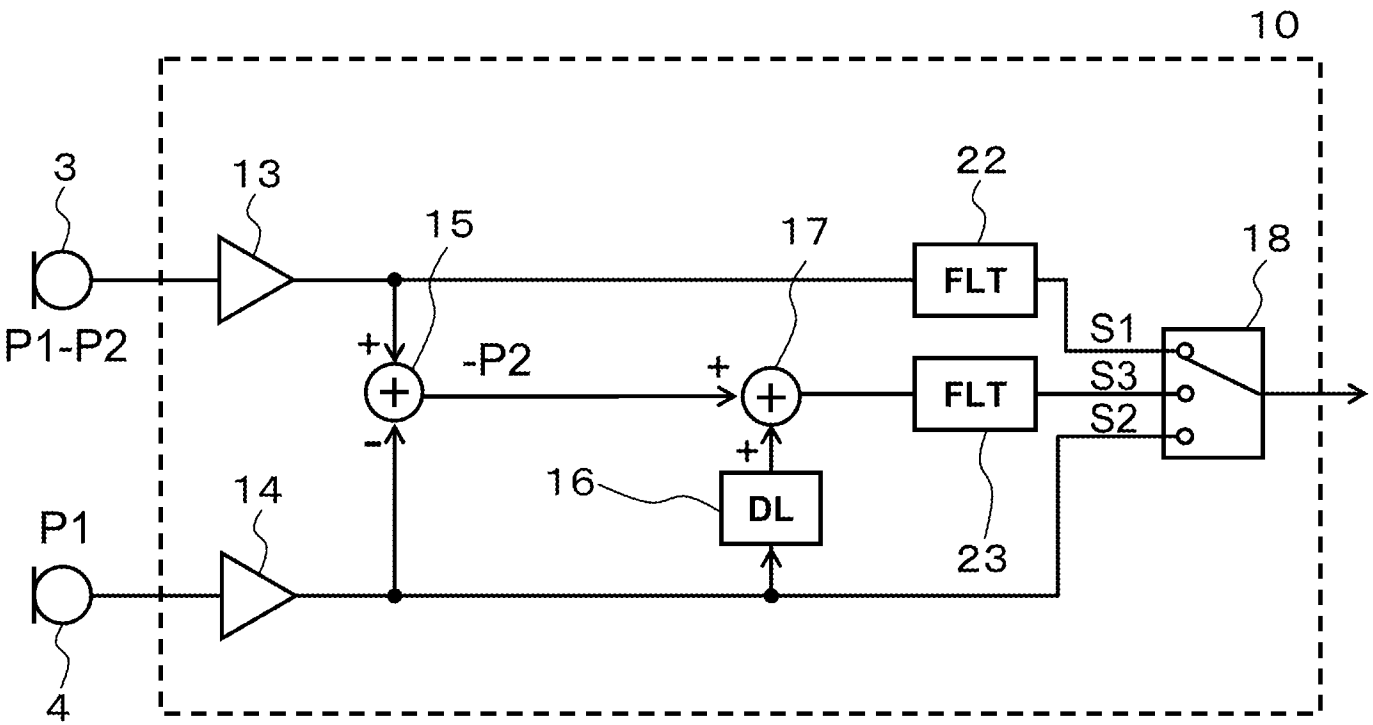
FIG. 14B is a diagram showing a modification example of an arithmetic processing according to the first embodiment, of a signal processor that includes a frequency correction filter.

Additionally, in FIG. 7A, a signal corresponding to (−P2) is delayed for a predetermined duration by the delay part 16. However, as shown in FIG. 7B, it is also acceptable for the delay part 16 to delay the second electrical signal S2 outputted by the second diaphragm 4, rather than the signal corresponding to (−P2), for a predetermined duration, and to then have the second adder 17 add together the signal corresponding to (−P2) and the delay signal (P1·D), and output an addition signal S3=(P1·D−P2). Likewise, it would be possible to modify the configuration shown FIG. 10A to the configuration shown in FIG. 10B; to modify the configuration shown FIG. 11A to the configuration shown in FIG. 11B; or to modify the configuration shown FIG. 14A to the configuration shown in FIG. 14B, respectively.

Figure 15B:
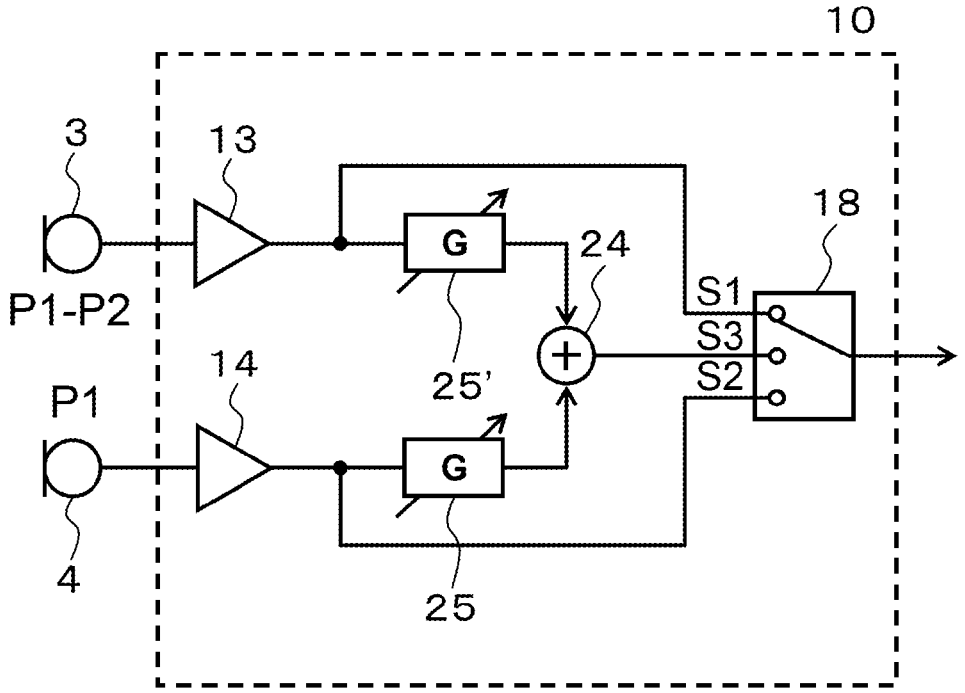
FIG. 15B is a diagram showing a modification example of an arithmetic processing according to the second configuration example of a signal processor.

Additionally, as in the configuration shown in FIG. 15B, a gain part 25' adapted to impart a predetermined gain G to the first electrical signal outputted by the first diaphragm 3, and output the signal, may be added to the configuration shown in FIG. 15A.

The microphone unit of the present invention may be implemented generally in speech input devices that input and process speech, and is suitable, for example, for a mobile phone or the like.

What is claimed is:

1. A microphone unit, comprising:

a substrate on which a first vibrating part and a second vibrating part respectively having diaphragms for converting input sound pressure into an electrical signal are arranged beside each other; and a cover arranged on the substrate and covering the first vibrating part and the second vibrating part;

wherein in the cover, a first sound hole forming a first sound path is formed through which an outside space communicates with one surface of the diaphragm of the first vibrating part and one surface of the diaphragm of the second vibrating part, in the substrate, a second sound hole forming a second sound path is formed through which the outside space communicates with another surface of the diaphragm of the second vibrating part, and a sound propagation distance from the first sound hole to the one surface of the diaphragm of the first vibrating part is substantially equal to a sound propagation distance from the second sound hole to the another surface of the diaphragm of the first vibrating part.

2. The microphone unit of claim 1, wherein the second sound path includes, within an interior layer of the substrate, a space extending in a direction parallel to the surface of the substrate on which the first and second vibrating parts are arranged beside each other.

3. The microphone unit of claim 1, further comprising a first calculator for calculating a difference between a first electrical signal output from the first vibrating part and a second electrical signal output from the second vibrating part.

4. The microphone unit of claim 3, further comprising:

a delay part for outputting a delay signal in which a predetermined delay is imparted to an output of the first calculator; and a second calculator for adding up the second electrical signal and the delay signal.

5. The microphone unit of claim 3, further comprising:

a delay part for outputting a delay signal in which a predetermined delay is imparted to the second electrical signal; and a second calculator for adding up an output of the first calculator and the delay signal.

6. The microphone unit of claim 3, further provided with:

a delay/gain part for imparting a predetermined delay and a predetermined gain to an output of the first calculator and producing an output; and a second calculator for adding up the second electrical signal and the output of the delay/gain part.

7. The microphone unit of claim 3, further comprising:

a delay/gain part for imparting a predetermined delay and a predetermined gain to the second electrical signal and producing an output; and a second calculator for adding up an output of the first calculator and the output of the delay/gain part.

8. The microphone unit of claim 4, wherein one of the first electrical signal, the second electrical signal, and an output of the second calculator is selected and outputted.

9. The microphone unit of claim 4, further comprising:

an analog-digital converter for sampling the first electrical signal and the second electrical signal at a predetermined frequency and converting the first and second electrical signals to digital signals;

wherein the predetermined delay is a delay that is an integral multiple of the sampling time of the analog-digital converter.

10. The microphone unit of claim 4, further comprising:

a filter for performing a low-pass filter process on the first electrical signal.

11. The microphone unit of claim 4, further comprising:

a filter for performing a low-pass filter process on an output of the second calculator.

12. The microphone unit of claim 4, further comprising:

a first filter for performing a low-pass filter process on the first electrical signal; and a second filter for performing a low-pass filter process on an output of the second calculator.

13. The microphone unit of claim 1, further comprising:

a gain part for imparting a predetermined gain to either the first electrical signal or the second electrical signal and producing an output; and a calculator for adding the other of the first electrical signal and the second electrical signal to the output of the gain part, and producing an output.

14. The microphone unit of claim 13, wherein one of the first electrical signal, the second electrical signal, and the calculator output is selected and outputted.

15. The microphone unit of claim 1, further comprising:

a first gain part for imparting a predetermined gain to the first electrical signal output from the first vibrating part and producing an output;

a second gain part for imparting a predetermined gain to the second electrical signal output from the second vibrating part and producing an output; and a calculator for adding up the output of the first gain part and the output of the second gain part, and producing an output.

16. The microphone unit of claim 15, wherein one of the first electrical signal, the second electrical signal, and the calculator output is selected and outputted.

17. A sound input device comprising:

a microphone unit, comprising a substrate on which a first vibrating part and a second vibrating part respectively having diaphragms for converting input sound pressure into an electrical signal are arranged beside each other; and a cover arranged on the substrate and covering the first vibrating part and the second vibrating part;

wherein in the cover, a first sound hole forming a first sound path is formed through which an outside space communicates with one surface of the diaphragm of the first vibrating part and one surface of the diaphragm of the second vibrating part, in the substrate, a second sound hole forming a second sound path is formed through which the outside space communicates with another surface of the diaphragm of the second vibrating part, and a sound propagation distance from the first sound hole to the one surface of the diaphragm of the first vibrating part is substantially equal to a sound propagation distance from the second sound hole to the another surface of the diaphragm of the first vibrating part.

* * * * *